US012448581B2

(12) United States Patent
Ishiguro et al.

(10) Patent No.: US 12,448,581 B2
(45) Date of Patent: Oct. 21, 2025

(54) AGENT, OIL COUNTRY TUBULAR GOODS, AND THREADED JOINT FOR OIL COUNTRY TUBULAR GOODS

(71) Applicants: JFE STEEL CORPORATION, Tokyo (JP); TOYO DRILUBE CO., LTD., Tokyo (JP)

(72) Inventors: Yasuhide Ishiguro, Tokyo (JP); Seigo Goto, Tokyo (JP); Takashi Koga, Tokyo (JP); Takamasa Kawai, Tokyo (JP); Seiji Ozaki, Tokyo (JP); Hideo Sato, Tokyo (JP); Sachiko Fujimoto, Tokyo (JP); Koichi Shoda, Tokyo (JP); Akira Okubo, Tokyo (JP); Ryota Kobayashi, Tokyo (JP); Ryota Kubo, Tokyo (JP); Kota Toyosawa, Tokyo (JP)

(73) Assignees: JFE STEEL CORPORATION, Tokyo (JP); TOYO DRILUBE CO., LTD., Tokyo (JP)

( * ) Notice: Subject to any disclaimer, the term of this patent is extended or adjusted under 35 U.S.C. 154(b) by 0 days.

(21) Appl. No.: 18/564,198

(22) PCT Filed: May 24, 2022

(86) PCT No.: PCT/JP2022/021281
§ 371 (c)(1),
(2) Date: Nov. 27, 2023

(87) PCT Pub. No.: WO2022/255169
PCT Pub. Date: Dec. 8, 2022

(65) Prior Publication Data

US 2024/0254405 A1 Aug. 1, 2024

(30) Foreign Application Priority Data

May 31, 2021 (JP) ..... 2021-091464

(51) Int. Cl.
*C10M 133/42* (2006.01)
*C10M 107/32* (2006.01)
(Continued)

(52) U.S. Cl.
CPC ..... *C10M 133/42* (2013.01); *C10M 107/32* (2013.01); *C10M 107/40* (2013.01);
(Continued)

(58) Field of Classification Search
CPC ..... C10M 133/42; C10M 107/32; C10M 107/40; C10M 111/04; C10M 129/52;
(Continued)

(56) References Cited

U.S. PATENT DOCUMENTS 6,102,576 A 8/2000 Toyota et al.
6,659,509 B2 12/2003 Goto et al.
(Continued)

FOREIGN PATENT DOCUMENTS

CN 101522874 A 9/2009
CN 102459544 A 5/2012
(Continued)

OTHER PUBLICATIONS

Sep. 20, 2024 Office Action issued in U.S. Appl. No. 18/564,142.
(Continued)

*Primary Examiner* — Cephia D Toomer
(74) *Attorney, Agent, or Firm* — Oliff PLC

(57) ABSTRACT

An agent for forming a solid lubricating coating film on a tightening surface of a thread portion, in which a solid lubricant is dispersed in a binder resin as a matrix component, a main component of the solid lubricant is melamine cyanurate, and an average particle diameter of the melamine cyanurate is 0.1 μm or more and 10.0 μm or less, the binder resin contains an alkyd resin and nitrocellulose, and the alkyd resin and nitrocellulose are contained in an amount of
(Continued)

85 wt % or more of the total binder resin component weight, and a total weight of the solid lubricant is 10 parts by weight or more and 100 parts by weight or less based on 100 parts by weight of a total weight of the binder resin.

20 Claims, 7 Drawing Sheets

(51) Int. Cl.
*C10M 107/40* (2006.01)
*C10M 111/04* (2006.01)
*C10M 129/52* (2006.01)
*C10N 50/08* (2006.01)

(52) U.S. Cl.
CPC ..... *C10M 111/04* (2013.01); *C10M 129/52* (2013.01); *C10M 2207/142* (2013.01); *C10M 2209/1023* (2013.01); *C10M 2215/222* (2013.01); *C10M 2217/0403* (2013.01); *C10N 2050/08* (2013.01)

(58) Field of Classification Search
CPC .... C10M 2207/142; C10M 2209/1023; C10M 2215/222; C10M 2217/0403; C10M 2201/041; C10M 2201/061; C10M 2203/065; C10M 2203/1006; C10M 2207/085; C10M 2207/126; C10M 2207/2815; C10M 2207/285; C10M 2213/062; C10M 2215/221; C10M 2217/065; C10M 169/04; C10N 2050/08; C10N 2010/02; C10N 2010/04; C10N 2010/06; C10N 2020/06; C10N 2030/06; C10N 2030/12; C10N 2050/02; C10N 2080/00; F16L 15/001; F16L 15/04
See application file for complete search history.

(56) References Cited

U.S. PATENT DOCUMENTS

| | | | |
|---|---|---|---|
| 8,202,825 | B2 | 6/2012 | Yamamoto |
| 9,194,515 | B2 | 11/2015 | Oshima et al. |
| 10,336,962 | B2 | 7/2019 | Goto |
| 11,198,793 | B2 | 12/2021 | Sasaki et al. |
| 11,326,118 | B2 | 5/2022 | Shitara et al. |
| 2006/0063684 | A1 | 3/2006 | Yamamoto |
| 2007/0225177 | A1 | 9/2007 | Murase et al. |
| 2008/0277925 | A1 | 11/2008 | Goto et al. |
| 2009/0078328 | A1 | 3/2009 | Albert et al. |
| 2009/0236850 | A1 | 9/2009 | Goto et al. |
| 2010/0264649 | A1 | 10/2010 | Goto et al. |
| 2010/0301600 | A1 | 12/2010 | Goto et al. |
| 2012/0101011 | A1 | 4/2012 | Makino et al. |
| 2013/0097982 | A1 | 4/2013 | Inui et al. |
| 2013/0277961 | A1 | 10/2013 | Goto et al. |
| 2014/0284919 | A1 | 9/2014 | Goto et al. |
| 2015/0001841 | A1 | 1/2015 | Oshima et al. |
| 2015/0191674 | A1 | 7/2015 | Goto et al. |
| 2015/0192229 | A1 | 7/2015 | Goto |
| 2015/0210888 | A1 | 7/2015 | Goto |
| 2016/0053590 | A1 | 2/2016 | Besijn et al. |
| 2016/0160920 | A1 | 6/2016 | Karaki et al. |
| 2016/0208194 | A1 | 7/2016 | Matsumoto et al. |
| 2017/0138526 | A1 | 5/2017 | Goto et al. |
| 2017/0167546 | A1 | 6/2017 | Satoi et al. |
| 2018/0118251 | A1 | 5/2018 | Maeda |
| 2018/0187119 | A1 | 7/2018 | Ito et al. |
| 2018/0201868 | A1 | 7/2018 | Goto |
| 2019/0003620 | A1 | 1/2019 | Goto et al. |
| 2019/0010767 | A1 | 1/2019 | Goto |
| 2020/0157379 | A1 | 5/2020 | Sasaki et al. |
| 2020/0166163 | A1 | 5/2020 | Goto |
| 2021/0364119 | A1 | 11/2021 | Goto |

FOREIGN PATENT DOCUMENTS

| | | | | |
|---|---|---|---|---|
| CN | 104513608 | A | 4/2015 | |
| CN | 106537016 | A | 3/2017 | |
| CN | 108912936 | A | 11/2018 | |
| CN | 112437803 | A | 3/2021 | |
| GB | 2 205 576 | A | 12/1988 | |
| JP | S63-286435 | A | 11/1988 | |
| JP | H01-289896 | A | 11/1989 | |
| JP | H03-168259 | A | 7/1991 | |
| JP | H08-103724 | A | 4/1996 | |
| JP | H08-105582 | A | 4/1996 | |
| JP | H08-165420 | A | 6/1996 | |
| JP | H11-199884 | A | 7/1999 | |
| JP | 2001-049285 | A | 2/2001 | |
| JP | 2001-065751 | A | 3/2001 | |
| JP | 2001-099364 | A | 4/2001 | |
| JP | 2002-310345 | A | 10/2002 | |
| JP | 2002-327874 | A | 11/2002 | |
| JP | 2002-348587 | A | 12/2002 | |
| JP | 2002-370067 | A | 12/2002 | |
| JP | 2004-010707 | A | 1/2004 | |
| JP | 2004-053013 | A | 2/2004 | |
| JP | 2005-299693 | A | 10/2005 | |
| JP | 2008-038108 | A | 2/2008 | |
| JP | 2008-069883 | A | 3/2008 | |
| JP | 2008-527249 | A | 7/2008 | |
| JP | 2008-537062 | A | 9/2008 | |
| JP | 2011-105831 | A | 6/2011 | |
| JP | 2011213761 | A | 10/2011 | |
| JP | 2013-108556 | A | 6/2013 | |
| JP | 2013-209960 | A | 10/2013 | |
| JP | 2013-545940 | A | 12/2013 | |
| JP | 2015-506445 | A | 3/2015 | |
| JP | WO2017/110685 | A1 | 8/2018 | |
| JP | 2019-140034 | A | 8/2019 | |
| JP | 6776485 | B1 | 10/2020 | |
| RU | 2221840 | C1 | 1/2004 | |
| RU | 2 729 482 | C1 | 8/2020 | |
| WO | WO-03102457 | A1 * | 12/2003 | ..... C10M 177/00 |
| WO | 2006/075774 | A1 | 7/2006 | |
| WO | 2006/104251 | A1 | 10/2006 | |
| WO | 2009/057754 | A1 | 5/2009 | |
| WO | 2009/072486 | A1 | 6/2009 | |
| WO | 2014/024755 | A1 | 2/2014 | |
| WO | 2014/042144 | A1 | 3/2014 | |
| WO | 2015/016322 | A1 | 2/2015 | |
| WO | 2015/030252 | A1 | 3/2015 | |
| WO | 2015/141159 | A1 | 9/2015 | |
| WO | 2017/110686 | A1 | 6/2017 | |
| WO | 2018/216416 | A1 | 11/2018 | |
| WO | 2019/021794 | A1 | 1/2019 | |
| WO | 2020/149310 | A1 | 7/2020 | |

OTHER PUBLICATIONS

Tsuru, E. et al., "Performance properties of tubular connection under hostile well condiations and optimum make-up procedure," Journal of the Japanese Association for Petroleum Technology, vol. 61, No. 6, pp. 527-536, Nov. 1996.
Jul. 19, 2022 International Search Report issued in International Patent Application No. PCT/JP2022/021278.
Jul. 26, 2022 International Search Report issued in International Patent Application No. PCT/JP2022/021279.
Aug. 2, 2022 International Search Report issued in International Patent Application No. PCT/JP2022/021281.
Nov. 21, 2023 International Preliminary Report on Patentability issued in International Patent Application No. PCT/JP2022/021278.
Nov. 21, 2023 International Preliminary Report on Patentability issued in International Patent Application No. PCT/JP2022/021279.
Nov. 21, 2023 International Preliminary Report on Patentability issued in International Patent Application No. PCT/JP2022/021281.
Jul. 11, 2023 Office Action issued in Japanese Patent Application No. 2022-550246.
Jul. 24, 2024 extended Search Report issued in European Patent Application No. 22815919.0.

(56) References Cited

OTHER PUBLICATIONS

Jul. 26, 2022 Written Opinion issued in International Patent Application No. PCT/JP2022/021279.
Aug. 2, 2022 Written Opinion issued in International Patent Application No. PCT/JP2022/021281.
Jul. 12, 2024 Office Action issued in Russian Patent Application No. 2023131333.
Jun. 28, 2024 Office Action issued in Russian Patent Application No. 2023131428.
Jul. 16, 2024 extended Search Report issued in European Patent Application No. 22815917.4.
U.S. Appl. No. 18/563,107 filed Nov. 21, 2023 in the name of Ishiguro et al.
U.S. Appl. No. 18/564,142 filed Nov. 27, 2023 in the name of Ishiguro et al.
Sep. 6, 2024 Office Action issued in Russian Patent Application No. 2023131446.
Sep. 6, 2024 Search Report issued in Russian Patent Application No. 2023131446.
Sep. 17, 2024 Extended European Search Report issued in European Patent Application No. 22815916.6.
Feb. 7, 2025 Notice of Allowance Issued in U.S. Appl. No. 18/564,142.
Apr. 1, 2025 Notice of Allowance received in U.S. Appl. No. 18/564,142.
May 20, 2025 U.S. Office Action issued in U.S. Appl. No. 18/563,107.
Jun. 10, 2025 Office Action issued in European Application No. 22815916.6.
Jul. 25, 2025 Office Action issued in Chinese Application 202280037212.X.
Jul. 25, 2025 Office Action issued in Chinese Application 202280038745.X.
Aug. 1, 2025 Office Action issued in Chinese Application 202280038774.6.

* cited by examiner

AGENT, OIL COUNTRY TUBULAR GOODS, AND THREADED JOINT FOR OIL COUNTRY TUBULAR GOODS

TECHNICAL FIELD

The present disclosure relates to a technology relating to lubrication and corrosion resistance of a threaded joint for oil country tubular goods. The present disclosure relates to a coating film structure in which a solid lubricating coating film is formed on a tightening surface (including a metal sealing surface) of a thread portion instead of a wet lubricating compound, and a technology relating to the threaded joint for oil country tubular goods. In the present specification, the tightening surface which is a surface of the thread portion includes the metal sealing surface.

Here, the solid lubricating coating film means a coating film including a binder resin as a matrix component, a solid lubricant dispersed and distributed in the binder resin, and an additive added as necessary. The present disclosure is intended to have corrosion resistance while improving lubrication by the solid lubricating coating film that realizes lubrication of a connection for oil country tubular goods.

In addition, in the present specification, the phenomenon described by the terms "lubricity" and "high lubricity" means a phenomenon of low friction and slipperiness in a broad sense. In addition, the high lubricity means that the number of times that make-up and break-out can be performed (also referred to as the number of times of make-up and break-out) is a specified number of times or more, in a narrow sense. For example, seizure resistance of the threaded joint for oil country tubular goods is described in the API 5C5 standard. In the API 5C5 standard, it is required that make-up can be performed three times in casing size. In addition, it is required that make-up can be performed 10 times in tubing size.

Note that in the present specification, a pipe having a female thread may be collectively referred to as a box. That is, the coupling is also described as a type of box.

BACKGROUND ART

In the threaded joint for oil country tubular goods, conventionally, in order to lubricate a thread portion, a surface treatment is performed on the tightening surface (sealing surface) (hereinafter, also simply referred to as "tightening surface") of the thread portion of at least one component of a male thread side and a female thread side by a Mn phosphate chemical conversion treatment film or electroplating using Cu or the like to form the coating film. Thereafter, a lubricating compound containing Pb, Zn, or the like was applied onto the coating film to lubricate the coating film.

Note that in the present specification, when the coating film is formed on the tightening surface (sealing surface) of the thread portion, the coating film is also referred to as a tightening surface.

On the other hand, in recent years, a non-wet lubrication technology by "dry dope free" has attracted attention. "Dry doped free" means that the film itself is not viscous liquid like the API-mod compound and does not contain harmful heavy metals. As such "dry dope-free" lubrication, there is a technology of forming the solid lubricating coating film on the tightening surface to achieve lubrication. The present disclosure is a technology related to this "dry dope-free" lubrication.

Here, in past patent literature, there are inventions related to various solid lubricating coating films. The solid lubricating coating film includes a lubricant component in charge of lubrication and a solid film as a matrix component that holds the lubricant component in the film. The solid film means a film having no viscosity and not a liquid film, and also means to complete lubrication when make-up and break-out the connection by itself. The conventional Mn phosphate film or Cu electroplating film itself is the solid film. However, since it is premised that lubrication is achieved by applying a grease-like compound, it is not included in the solid lubricating coating film. In the present disclosure, lubrication is achieved as the solid film, and an organic resin film is assumed as the solid film. Therefore, in the following description, the solid film is also referred to as the binder resin.

The present disclosure utilizes a hard film made of an alkyd resin, cellulose, and a derivative thereof as a binder resin component, with MCA as a main component of the solid lubricant. The present disclosure particularly utilizes cellulose and derivatives thereof as nitrocellulose. In addition, there is a group called lacquer among commercially available coating material groups, and there is a coating material classification including the alkyd resin and nitrocellulose as a mainstream of the group called lacquer. It cannot be said that those in the coating material classification are particularly excellent in lubrication. These are generally used as general coating materials, and quick-drying paints in hobby fields such as plastic models. These are optimized for rust prevention and decoration, and characteristics related to lubrication are not particularly guaranteed. Therefore, in order to lubricate it, it is necessary to optimize the composition of the components of the alkyd resin and nitrocellulose, as well as the selection of the lubricant and the optimization of the content range of the components. However, although it is not a completely matching patent literature, past literatures relating to the alkyd resin, a nitrocellulose-based resin, and the like as individual components have been published.

Here, as patent literature in which MCA is included as the solid lubricant, there are, for example, PTLs 1 to 4. In PTLs 1 to 3, MCA is exemplified as one of candidates for solid lubricant powder of the connection for oil country tubular goods. In addition, PTL 4 discloses that MCA is used as one of the essential materials for the solid lubricating coating film of the oil country tubular goods.

Further, the alkyd resin is described in PTL 5. PTL 5 proposes a surface layer in which inorganic silica particles are dispersed as an alternative treatment to the conventional chromate treatment on a surface of a metal material. Then, in PTL 5, the alkyd resin is included as one of the candidates as a resin for binding silica.

PTL 6 describes a case of providing nitrocellulose, and exemplifies cellulose as one of the candidates as an example of carbohydrates that may be mixed into the lubricating coating film. Then, PTL 6 exemplifies a material that is single or blend of the candidates including cellulose, an acrylic resin, a vinyl chloride resin, polyvinyl butyral, rubber, a fluororesin, and the like as a material for forming a film holding a lubricating powder.

PTL 7 also exemplifies nitrocellulose. In PTL 7, there is a liquid lubricating layer in a lower layer, and the solid lubricating coating film is formed thereon. Then, the nitrocellulose is exemplified as one of the candidates as the binder resin of the solid lubricating coating film. In PTL 7, natural drying is premised in order to form an upper layer while protecting the liquid lubricating film of the lower layer. Then, the nitrocellulose is exemplified as one of the candidates for the binder resin of the upper layer that can be made by natural drying.

In addition, although it is not an example of evaluation of the solid lubricating coating film, NPL 1 describes a make-up test method with vertical power tongs using a short pin. NPL 1 describes a method of performing the evaluation in a state in which a weight of 5 kN (510 kg weight) is constantly loaded during make-up and break-out regardless of the outer diameter and wall thickness of the oil country tubular goods to be evaluated. In NPL 1, 7"29 #and 7"35 #are described as pins, and assuming that the length of the pin is 40 feet (≈12 μm) close to the actual length of Range-3, the pin load is about 520 kg or about 630 kg. Therefore, it seems that the weight of one evaluation size is applied during tightening and loosening. In addition, judging from the torque turn chart, since the make-up is completed in a half turn (see FIG. 5 and the like of NPL 1), it can be seen that the initial setting position of the coupling and the pin by hand make-up immediately before the start of make-up is started from a state in which the threads are almost completely engaged with each other.

CITATION LIST

Patent Literature

PTL 1: WO 2018/216416
PTL 2: JP 2008-069883 A
PTL 3: JP 2008-537062 A
PTL 4: WO 2014/024755
PTL 5: WO 2009/057754
PTL 6: JPWO 2017/110685
PTL 7: JP 2004-053013 A

Non Patent Literature

NPL 1: Tsuru et al., Journal of Japan Petroleum Institute, Vol. 61, No. 6 (1996), pp. 527-536. (FIG. 1)

SUMMARY OF INVENTION

Technical Problem

The inventors have studied the solid lubricating coating film with reference to a material of the solid lubricating coating film described in a known prior art such as the above-mentioned patent literature. Specifically, the inventors have studied the lubricity of the film structure in which the blending ratio of cellulose and derivatives thereof to the alkyd resin is optimized to adjust the hardness of the binder resin, and then the addition amount of melamine cyanurate (MCA) used as the solid lubricant is optimized in order to further improve lubrication. Furthermore, the inventors have studied whether the anticorrosion properties can be maintained. Further, in the study, cellulose and derivatives thereof were studied mainly on nitrocellulose. However, in the past patent literature, there is no example in which this combination is used for improving lubrication and anticorrosion. That is, in the past patent literature, although the usage conditions and the like are different, only a suitable range is specified for individual component alone.

Here, examples of using MCA as the solid lubricant are described in PTLs 1 to 4. However, MCA is merely exemplified as one listed as the candidates for the solid lubricant. In addition, PTLs 1 to 3 do not specify the alkyd resin as the binder resin that holds the solid lubricant. At this time, even if the alkyd resin is broadly regarded as a polyester resin, the polyester resin is not listed as the candidate for the binder resin. PTL 4 is a film containing semi-solid or viscous fat and oil or the like rather than a hard resin film, and thus is utilized differently from the present disclosure. Then, in PTLs 1 to 4, only MCA is exemplified, and it is not described in detail such that a specific size range or a specific concentration range is suitable.

Further, an example in which the alkyd resin is used as the binder resin is described in PTL 5. However, PTL 5 is not an application example to the connection for oil country tubular goods, but is intended for a wide range of metallic materials. Furthermore, PTL 5 does not mainly contain the alkyd resin. In the context of the invention in which the silica particles are used as a rust preventive coating layer, the alkyd resin is only listed as one possibility of a binder in the candidates for coating films in which the silica particles are used as a fixing binder. This is not particularly consistent with the fields covered by the present disclosure.

The nitrocellulose is described in PTLs 6 and 7. In PTL 6, the carbohydrate is exemplified as an example of an additive to be contained in the lubricating coating film. Then, carbide is exemplified as a material that changes the film quality to the high viscosity side at high temperature.

While the nitrocellulose is used as the binder resin in the present disclosure, PTL 7 is an application example based on an idea different from that of using nitrocellulose as the binder resin. That is, PTL 7 is the application example of a solid layer in a lubricating film structure having a two-layer structure of a liquid layer and a solid layer.

In PTL 7, the nitrocellulose is exemplified as one of the candidates as a resin that cures in a room temperature range in order to retain the solid lubricant. However, polymerization with the alkyd resin as in the present disclosure is not assumed.

As described above, none of the patent literature describes the solid lubricating coating film based on the nitrocellulose and the alkyd resin for the purpose of achieving both lubrication and anticorrosion. In the first place, in the lubricating coating film using cellulose, a cellulose derivative, or nitrocellulose, the film of these single bodies is brittle. Therefore, it is not useful for lubricating applications. There is a need to optimize the formulation with the alkyd resin, the addition of an appropriate amount of solid lubricant, and the balance of the binder resin and the solid lubricant. That is, it is difficult to realize the expected lubrication only by simply bringing and mixing these components. It is necessary to clarify detailed conditions of individual components and to separately add appropriate additives. However, such a point is not described in any patent literature.

Further, the lubrication of the connection for oil country tubular goods intended by the present disclosure is in a special sliding condition.

That is, at the site (actual well), the pin having an actual length of about 8 m or more and less than 15 m is made up and broken out to the box set below. At this time, although the pin is made up and broken out using the power tongs in a state of being lifted by a crane, a total load of the pin may be applied to a box connection. That is, the lubrication is performed in a large load application state.

Further, at this time, the pin is not always made up and broken out in an ideal state. That is, at the time of make-up, the pin connection is inserted into the box connection or set in a slightly tightened state by hand. However, the pin is not set upright and immobile with respect to the box connection. Further, the pin is not set in a state of being erected straight (without bending) while being inclined in an oblique direction. That is, the upper end side (tip side opposite to the tightening side) of the pin is slightly bent according to the elastic modulus (Young's modulus) of the material and the actual pin length while the lower portion is constrained by the box connection. In particular, in the case of a pin having a length of 8 m or more, when viewed from below, the pin appears to bend while being set straight in the box. From that state, the pin is made up and broken out. Therefore, the box connection and the pin connection are never made up and broken out in a state where the load is uniformly and symmetrically applied. Therefore, make-up and break-out are performed in a state where a part of a connection surface is locally strongly hit (lubrication in an unbalanced load state). In addition, a portion that is locally strongly hit varies depending on make-up and break-out.

In a conventional lubrication technology using a grease-like compound, the compound follows and moves during make-up and break-out. Therefore, the lubricant (lubricating compound) functions to converge make-up and break-out in a favorable direction even when there is a slight change in lubrication conditions or the like. Therefore, in an evaluation test (also referred to as a laboratory test) of make-up and break-out the threaded joint, it is possible to grasp a lubrication state of an actual size pin by evaluation using a short pin without relying on evaluation using the actual size pin.

On the other hand, according to the investigation of the inventors, in the technology of lubricating the connection for oil country tubular goods using the solid lubricating coating film, the solid lubricating coating film is inevitably shaved to some extent. Further, it is necessary to devise such that the shavings do not clog a connection gap. In addition, at this time, the shaved secondary formed product derived from the solid lubricating coating film does not always move following the make-up and break-out.

This is what happens in real wells and is very different from the case of lubrication using a wet lubricating compound.

Then, in the threaded joint for oil country tubular goods, it has been found that the lubrication technology of the connection for oil country tubular goods using the solid lubricating coating film cannot be evaluated in the same evaluation as the lubrication technology using the conventional grease-like compound, and optimistic evaluation is obtained. That is, it has been found that, in the conventional patent literature, the evaluation of make-up and break-out of the threaded joint for oil country tubular goods is often the evaluation of lubrication using the wet lubricating compound even if it is the evaluation of the solid lubricating coating film, and thus the lubrication conditions (suitable ranges of the components, or the like) of solid lubricating coating film described in the past patent literature cannot be employed as they are.

That is, when evaluating the solid lubricating coating film in the laboratory test, the influence of a large load and an unbalanced load cannot always be simulated in the evaluation using the short pin as in the case of lubrication using the lubricating compound for the above reason. In the evaluation using the short pin shorter than the situation in the actual well, it has been found that the solid lubricating coating film is less likely to be shaved, and it is not possible to create a situation in which the seizure behavior in the actual well can be simulated.

As described above, in the evaluation using the conventional short pin, the secondary product including the shavings of the solid lubricating coating film is clogged and seized, or the secondary product is pressed against the tightening surface again, and thus it is not possible to simulate situations such as maintaining the effect like the lubricating film. That is, in the conventional evaluation simply using the short pin, the evaluation of the solid lubricating coating film is inevitably optimistic, and there is a problem that when physical property parameters of the solid lubricating coating film is determined, a region that is originally not acceptable is erroneously evaluated as a suitable range.

Therefore, the inventors have found that, in the prior art literature, the suitable range is often described on the basis of the optimistic evaluation as described above.

As described above, it has been found that the following (1) and (2) need to be considered as specificity of lubrication of the connection for oil country tubular goods.

(1) There is structural backlash (allowance) in the initial stage of make-up of a connection and the late stage of break-out of connection.

(2) Lubrication and friction in a state where a large weight is applied from above is targeted.

That is, it is necessary to make the situation similar to that in the actual well in which the connection for oil country tubular goods is exposed during make-up and break-out. That is, it is necessary to define the parameters related to the solid lubricating coating film on the premise that the make-up and break-out are performed with the large load and the unbalanced load. It has been found that it is necessary to complete the invention after ensuring lubricity and clarifying the meaning of definition of the upper and lower limits of the parameters in accordance with such actual use conditions.

As described above, it is important to define the upper and lower limits of the parameters in a situation according to the actual well. Conventionally, the lubrication behavior to be verified in the lubrication of the connection for oil country tubular goods has been evaluated on the make-up and break-out behavior and the number of make-up and break-out times with the power tongs using the short pin. In the conventional grease compound, the compound also moves in conjunction with the make-up and break-out. Therefore, when evaluating the lubrication, no particular problem arises whether the lubrication is evaluated by the horizontal tongs using the short pin or by the vertical tongs, and the lubrication behavior can be evaluated. That is, in the conventional grease-like compound, the evaluation can also be performed using the short pin, including the design of the thread, availability of the base layer such as chemical conversion treatment and electroplating, and the comparative evaluation of the compound itself.

On the other hand, this is not the case in the case of lubrication of the solid lubricating coating film. The evaluation using the short pin does not simulate the actual well, and rather optimistic evaluation is obtained for the lubrication. An evaluation of "fail" using the short pin is consistent with an evaluation of "fail" in the make-up and break-out in the actual well. However, on the other hand, it does not necessarily mean that an evaluation of "pass" using the short pin will be an evaluation of "pass" in the make-up and break-out in the actual well. The problem is that the evaluation of "pass" using the short pin also includes the evaluation of "fail" in the make-up and break-out in the actual well.

In addition, since the lubrication of the connection for oil country tubular goods is different from other lubrication behaviors, there is a problem that the definition by evaluation based on other lubrication conditions cannot be applied.

In general, regarding the lubrication behavior between two objects that rub against each other, a situation is assumed in which one object is fixed and the other object moves. Then, for a moving object, it is assumed that the lubrication starts from a state in close contact with a fixed object. Even when both objects move, the lubrication usually starts from a state of being stuck together.

On the other hand, in the lubrication of the connection for oil country tubular goods, the pin connection (male thread) starts from a state in which there is backlash by the allowance of the connection with respect to the box connection (female thread) in the initial stage of make-up. Therefore, the threads are not always in stable contact with each other until the threads are engaged with each other to some extent. That is, in the lubrication of the connection for oil country tubular goods, the case where the threads strongly hit each other and the case where the threads hardly hit each other are unevenly distributed. Then, there is a high possibility that the lubricating film is damaged when the threads strongly hit each other. Further, in the lubrication after the threads are engaged with each other, they slide under the influence of the lubrication state in the place.

In particular, in a situation where there is "backlash" until the threads are engaged with each other, in the case of the solid lubricating coating film, there is a problem that the solid lubricating coating film is directly affected by the unbalanced load derived from the backlash, to be easily damaged.

In particular, in the case of the lubricating coating film, which is an object of the present disclosure, including cellulose, a cellulose derivative, or nitrocellulose and the alkyd resin, inherent brittleness of the binder resin is a key. In the use conditions in the actual well, particularly in a state where there is backlash before the threads are engaged with each other, the coating film is completely peeled off, or the coating film is broken. In this phenomenon, it is necessary to design the solid lubricating coating film so that the lubrication can be secured.

In addition, in the actual well, there is an influence that the total weight of the pin connection is applied to the box connection during make-up and break-out. In addition, since there is backlash as described above, the load is not uniformly applied, and the pin tends to eccentrically rotate until the threads are engaged with each other. Therefore, the solid lubricating coating film needs to be a film that allows the lubrication to withstand the large load applied as the unbalanced load. A film that can be completely removed or a film that can be almost completely broken and disappear cannot handle the large load. In the actual well, the oil country tubular goods are often operated at about 12 to 16 m. For example, the oil country tubular goods with a length of about 12 m (about 40 feet) weighs about 1 t at an outer diameter of 9 to ⅝". In a marine rig, three pin connections connected in advance are often made up and used. Therefore, when the oil country tubular goods having an outer diameter of 9 to ⅝" is used, about 3 tons is applied to the box side in a severe situation.

In lubrication of the connection for oil country tubular goods, it is necessary to assume the lubrication that withstands such a large load and an unbalanced load. Then, as a result of various studies, the inventors have found that what is important is to devise the solid lubricant and the binder resin in consideration of how to suppress damage to the solid lubricating coating film in a situation of the large load and in a situation where there is "backlash" until the threads are engaged with each other.

On the other hand, in the past patent literature, it is hard to say that the solid lubricating coating film is designed based on such a viewpoint. For example, in PTL 1, it is clear that the backlash is not taken into consideration because it is described that the threads are tightened until they are engaged with each other by tightening by hand, in the initial stage of make-up. In addition, the fact that the threads are tightened until they are engaged with each other, indirectly indicates that it is a laboratory evaluation using the short pin. In the actual well, the connection cannot be easily tightened until the threads are engaged with each other. It is almost not possible for the actual size pin connection to be set in an ideal upright state. The pin is bent and tightened to some extent. Therefore, in most cases, the tightening by hand is completed at a position where the pin connection does not completely fit in the coupling. In PTLs 2, 3, 4, and 6, the make-up speed is 10 rpm. PTL 7 describes that the make-up test is performed at a make-up speed of 20 rpm as a test simulating an operation in a real pipe, and a make-up and break-out test is performed. They do not disclose information on the initial make-up position. However, since it is not particularly specified that the make-up was performed in the actual well, it is estimated that they are results of using the short pin in the laboratory. Further, in the instruction manual of the connection provided by the applicants of these patent literatures, there is an instruction to tighten the connection at 1 rpm or less when making up the connection. Also from this, it is presumed that the make-up and break-out test in these patent literatures is the laboratory test. Since it is not particularly specified, when the make-up is started with the power tongs, it does not appear that the make-up is started from a portion where there is backlash when setting the pin connection and the box connection by tightening by hand.

Here, in a method for applying the grease-like compound, the viscous liquid grease-like compound also moves in conjunction with the make-up and break-out. Therefore, the influence of the large load and the unbalanced load is alleviated to a considerable extent. Therefore, there is no particular problem in evaluating with the horizontal tongs or the vertical tongs using the short pin, and the lubrication behavior can be evaluated.

On the other hand, in the case of the lubrication behavior of the connection for oil country tubular goods using the solid lubricating coating film, the solid lubricating coating film corresponding to the viscous liquid grease-like compound is damaged and peeled off even in the tightening until the threads are engaged with each other or the tightening after the threads are engaged with each other. Alternatively, the solid lubricating coating film is inevitably shaved gradually thinly. The peeled shavings do not always move in conjunction with the make-up and break-out unlike the grease-like compound. The fact that the secondary product derived from the shaved solid lubricating coating film is released into a gap between the pin connection and the box connection greatly affects the lubrication. If the connection gap is closed, it will directly lead to seizure. Alternatively, when it is pressed down with the large load, it moves in conjunction with the make-up and break-out. The secondary product may be reconstituted by being pressed down, and be reattached as a film to one of the threads, to improve lubrication.

In the conventional case using the short pin, neither the large load nor the unbalanced load occurring in the actual well can be simulated. Therefore, in the conventional laboratory test, an amount of the secondary product itself derived from the solid lubricating coating film is small, and the lubrication behavior is often erroneously determined to be pass. Therefore, it has often been noticed that the design of the solid lubricating coating film is not good only when the pipe is applied to the actual well. Moreover, it is not possible to simulate what is actually occurring in the well without intentionally creating a situation where there is "backlash" until the threads are engaged with each other.

On the other hand, it is not a reality to perform a test every time in the actual well or a simulated well (a test site where the make-up and break-out test is performed with an actual pin) using the actual pin. The experimental cost is enormous and is not realistic. The latter requires a rental cost of about 10 million yen or more per day, and even in the solid lubrication test, it is estimated that the maximum number of tests is 10 to 20 of make-up and break-out when the diameter is small, and it takes enormous cost to perform the tests.

In most of the past patent literature, such consideration is not given in the evaluation of the solid lubricating coating film. Then, lubrication evaluation of the connection is not particularly specified, and there are many cases of application in the horizontal tongs and vertical tongs using the short pin, which are often used in the laboratory. When these evaluations are made, the influence of the large load and the unbalanced load is eliminated, and thus most of the results are basically good. Therefore, even if the preferred upper and lower limits are set in these evaluation methods, it does not mean a truly suitable range.

Even under the conditions selected by the evaluation of the short pin in the laboratory, it cannot be said that the technology is specified because they include conditions in which the lubrication is not good in the actual well.

Here, although it is not an investigation of the lubrication behavior of the solid lubricating coating film, in NPL 1, a load of 510 kg weight is continuously applied throughout make-up and break-out of the connection. This may mean applying a weight corresponding to one actual pin of 7" size. As described above, in the evaluation of the solid lubricating coating film, it is important to simulate the large load and the unbalanced load as occurs in the real well. This is because the secondary phenomenon caused by the secondary product derived from the solid lubricating coating film greatly affects the lubrication. However, in NPL 1, it is difficult to say that the large load is necessarily simulated depending on the size.

In addition, in NPL 1, the unbalanced load cannot be simulated. As can be seen from FIG. 1 and the like of NPL 1, especially in the case of the premium joint, there is no one rotation before make-up. Therefore, there is a problem that the initial make-up position (make-up start point) by tightening by hand is intended to test lubrication performed from a state where the threads are engaged with each other.

Here, although it is not easily noticed, if the above load is continued even during make-up, there is the following problem. That is, although it is a pitfall in the laboratory evaluation, it has been found that, the weight is a balancer during loosening, and the connection is loosened straight from the initial make-up position without backlash. Therefore, the pin does not swing around, and the occurrence of seizure during make-up as occurs in the actual well cannot be appropriately simulated. In some situations, a situation may occur that may lead to the misunderstanding that lubrication properties are good. Therefore, in the condition parameters related to the solid lubricating coating film, there is a need to simulate in view of both a lubrication state in which the threads are not sufficiently engaged with each other and a lubrication state after they are engaged with each other, and to prove that the solid lubricating coating film has excellent lubrication properties.

For lubrication of the connection for oil country tubular goods using the solid lubricating coating film, by defining and optimizing the binder resin and the solid lubricant as the additive in the binder resin, it is necessary to realize lubrication corresponding to a lubrication level realized by conventional compounds.

However, the evaluation for the conventional solid lubricating coating film has not been made under the conditions that occur in the actual well as described above. That is, it is necessary to define a suitable range of the solid lubricating coating film by a test method reflecting the above points. However, such a laboratory test has not been conventionally performed.

The present invention has been made in view of the above points, and an object of the present invention is to realize seizure resistance (galling resistance) equal to or higher than that of the dope compound method of the prior art in terms of lubrication properties during make-up and break-out of the oil country tubular goods by using a solid lubricating coating film.

Solution to Problem

The present disclosure is to form a solid lubricating coating film mainly including a binder resin containing nitrocellulose and an alkyd resin, with melamine cyanurate (MCA) as a main component of a solid lubricant, which has not received attention in the past.

In addition, in view of the above problems, as a result of study by the inventors, it has been found that the above problems can be solved through preparation of an agent, development of the solid lubricating coating film of a connection for oil country tubular goods, a method for checking the solid lubricating coating film, and the like.

It has been found that the important points are to control the following four and the conditions of the matters related to them to a suitable range.

(a) Defining upper and lower limits of the individual parameters and clarifying preferred ranges thereof, by checking by make-up in an actual well, or by an appropriate test method that simulates make-up and break-out in the actual well (b) Defining an optimum range of melamine cyanurate (MCA) as the main component of the solid lubricant using the above (a)

(c) Defining an optimum range of the nitrocellulose and the alkyd resin as the main component using the above (b)

(d) In addition, defining additives, plasticizers, solvents, and the like

From the above findings, in order to solve the problem, one aspect of the present invention is an agent for forming a solid lubricating coating film on a thread portion of oil country tubular goods, in which a solid lubricant is dispersed in a binder resin, a main component of the solid lubricant is melamine cyanurate, and an average particle diameter of the melamine cyanurate is 0.1 μm or more and 10.0 μm or less, the binder resin contains an alkyd resin and nitrocellulose, and the alkyd resin and nitrocellulose are contained in an amount of 85 wt % or more of the total binder resin component weight, and a total weight of the solid lubricant is 10 parts by weight or more and 100 parts by weight or less based on 100 parts by weight of a total weight of the binder resin.

Further, an aspect of the present invention is oil country tubular goods with a lubricating coating film including a solid lubricating coating film formed on a thread portion, in which the lubricating coating film including the solid lubricating coating film is formed on a tightening surface of the thread portion of at least one component of the box and the pin, the solid lubricating coating film includes a solid lubricant dispersed in a binder resin, a main component of the solid lubricant is melamine cyanurate, and an average particle diameter of the melamine cyanurate is 0.1 μm or more and 10.0 μm or less, the binder resin contains an alkyd resin and nitrocellulose, and the alkyd resin and nitrocellulose are contained in an amount of 85 wt % or more of the total binder resin component weight, and the total weight of the solid lubricant is 10 parts by weight or more and 100 parts by weight or less with respect to 100 parts by weight of the total weight of the binder resin.

Advantageous Effects of Invention

According to an aspect of the present invention, it is possible to provide a solid lubricating coating film capable of imparting favorable lubricity and corrosion resistance to a connection for oil country tubular goods while employing MCA as the solid lubricant.

For example, according to the aspect of the present invention, a threaded joint for oil country tubular goods having lubricating performance and corrosion resistance during make-up can be obtained in consideration of actual well equivalent conditions that may occur in an actual well environment. Note that the conditions equivalent to the actual well are conditions in which a pin weight is applied to the box from above, a load is applied obliquely due to a deviation of the axial center, and the load is applied locally rather than uniformly in many cases, or the like.

BRIEF DESCRIPTION OF DRAWINGS

FIGS. 4A and 4B are schematic diagrams of make-up charts, in which FIG. 4A is a case of the actual well, and FIG. 4B is a case of the conventional laboratory test;

DESCRIPTION OF EMBODIMENTS

Next, an embodiment of the present invention will be described with reference to the drawings.

Here, as a result of repeated studies by the inventors, it has been found that make-up and break-out with a solid lubricating coating film is divided into lubrication situations of two phases, and it is necessary to consider the situations that occur in each phase.

Figure 2B:
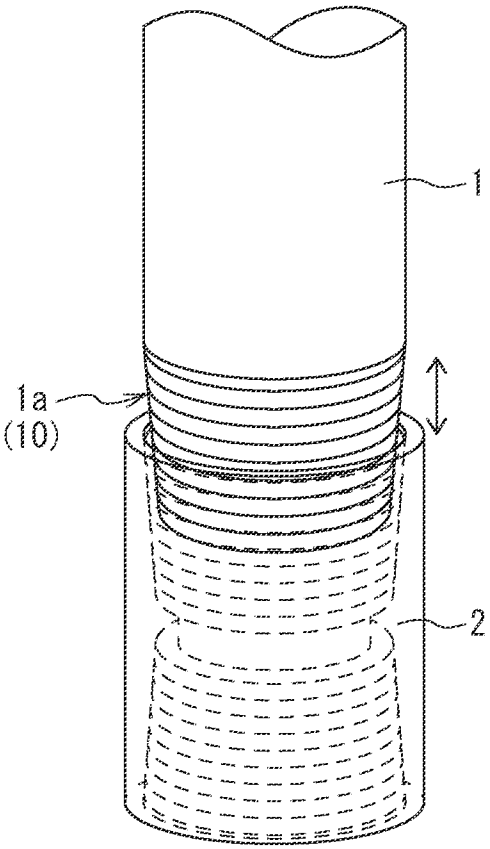
FIG. 2B is a diagram illustrating an initial set position at that time.
Figure 2A:
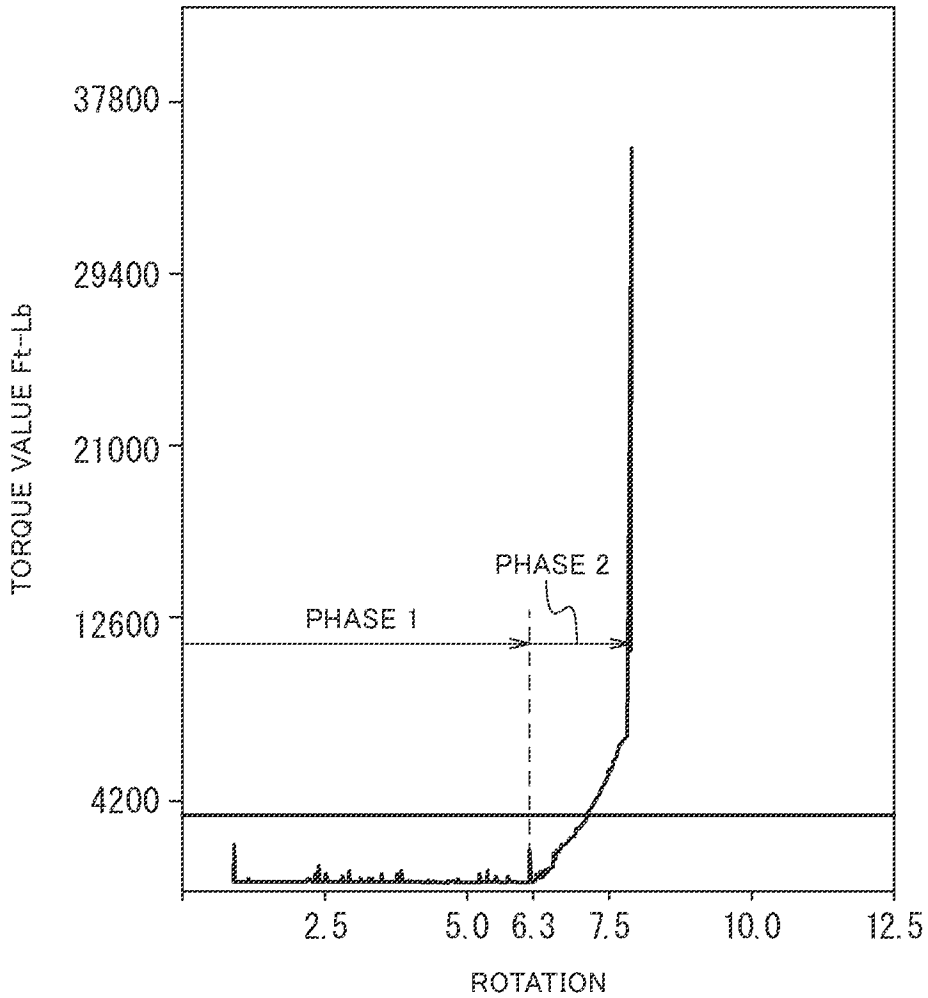
FIG. 2A is a diagram of a make-up chart in an actual well.

<Regarding FIGS. 2A and 2B>

FIG. 2A is an example of a torque turn chart occurring in an actual well.

The condition of FIG. 2A is a torque turn chart (make-up chart) when a make-up test is performed using a pin having an actual length of 40 feet (≈12 m) by simulating the actual well. In an actual oil field/gas field, the make-up is often started from a situation where the threads are not sufficiently engaged with each other. In view of this situation, FIG. 2A is an example in which the make-up is started from a state in which the initial set position is that a pin connection is about half exposed at the start of initial make-up as illustrated in FIG. 2B. Note that a 9 to ⅝" 53.5 #Q125 JFE-LION™ connection was used as the pin. Further, from the viewpoint of simulating the actual well, a pin having a length of slightly more than about 40 feet (pin having a length of Range-3) was used.

Then, FIG. 2A is a chart when the pin is made up with vertical tongs while the entire length of the pin is hung from above a rig by a crane.

This FIG. 2A can be regarded as a situation that often occurs in the actual well. This torque turn chart is interpreted in two phases. A make-up/break-out region in a state where threads of a box and the pin are not completely engaged with each other is referred to as "phase 1". A region where the threads are engaged with each other, a steady torque starts to rise, and the torque increases according to the make-up is referred to as "phase 2".

It should be noted in FIG. 2A that before a point at which the torque continuously increases (a region where the rotation number is 6.3 rotations or less in FIG. 2A: phase 1), the torque should not rise in principle. However, actually, in phase 1, spike-like torque tends to rise irregularly and frequently.

This suggests that in the region of phase 1, the pin connection irregularly and locally contacts the box connection while rotating. This is the situation that occurs in the make-up of the actual well.

Then, in phase 1, it means that the solid lubricating coating film is broken and peeled off inevitably to some extent depending on the design and optimization of the solid lubricating coating film. What should be emphasized here is that the state of FIG. 2A is not the worst state intentionally created, but rather is a torque turn chart of a sample with a very common solid lubricating coating film.

Figure 3B:
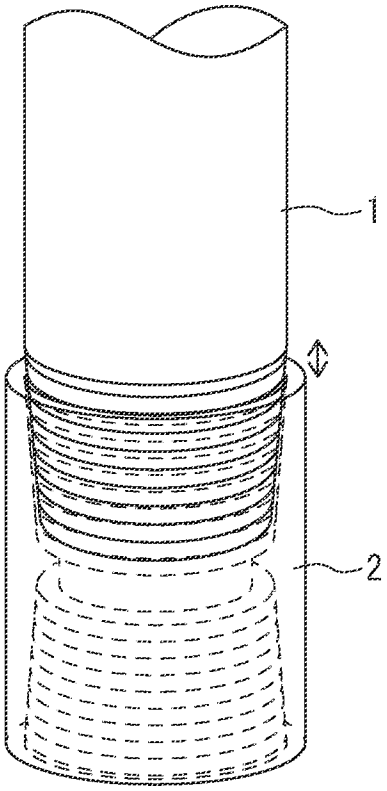
FIG. 3B is a diagram illustrating an initial set position at that time.
Figure 3A:
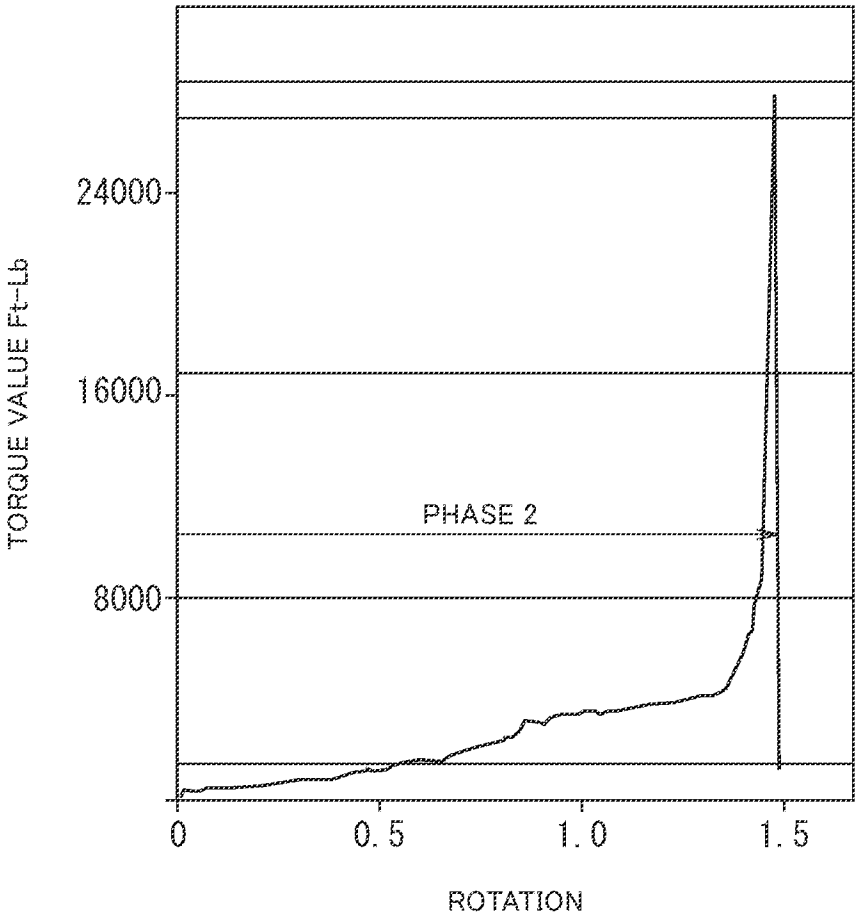
FIG. 3A is a diagram of a make-up chart in a conventional laboratory test.

<Regarding FIGS. 3A and 3B>

On the other hand, FIG. 3A is a torque turn chart in a case where the same solid lubricating coating film as in FIGS. 2A and 2B is used and the pin is made up with vertical power tongs.

In FIGS. 3A and 3B, the pin having the same outer diameter, thickness, and connection type as those in FIGS. 2A and 2B is employed, but the short pin having a length of about 1 m is employed as the pin. In this case, the weight equivalent to about 100 kg of the short pin's own weight is applied to the box connection.

Further, FIG. 3A is a make-up chart (torque turn chart) when the make-up is started from a state where the threads are sufficiently engaged with each other. That is, as illustrated in FIG. 3B, it is the make-up chart (torque turn chart) when exposure of the pin connection is about 1 to 3 threads at the start of initial make-up.

The condition of FIG. 3A is also a condition often used at the time of make-up in a conventional laboratory test, and is a case where the connection is set until the connection is bitten by tightening by hand. In short, as compared with the case of FIGS. 2A and 2B, this is an example in which the load is small (there is no influence of a large load) and initial whirling of the connection does not occur (there is no influence of an unbalanced load).

In FIG. 3A, it is necessary to pay attention to the fact that the unit of the horizontal axis is different from that in FIG. 2A.

In FIG. 3A, since the tightening by the tongs is started at a state where the tongs are tightened by hand to a state where the threads are engaged with each other, the spike-like torque as seen in FIG. 2A is not observed.

As can be seen from FIGS. 3A and 3B, in the conventional laboratory test, a position where the threads are tightened by tightening by hand until they are engaged with each other is often set as an initial position of tightening by the power tongs. Therefore, there is no behavior in phase 1 until the threads are engaged with each. Therefore, the conventional laboratory test is a test for evaluating only the make-up and break-out under the condition that destruction of the solid lubricating coating film that should occur before the threads are engaged with each other does not occur (under the condition without the phase 1), that is, in a region of only phase 2 after the threads are engaged with each.

Figure 4A:
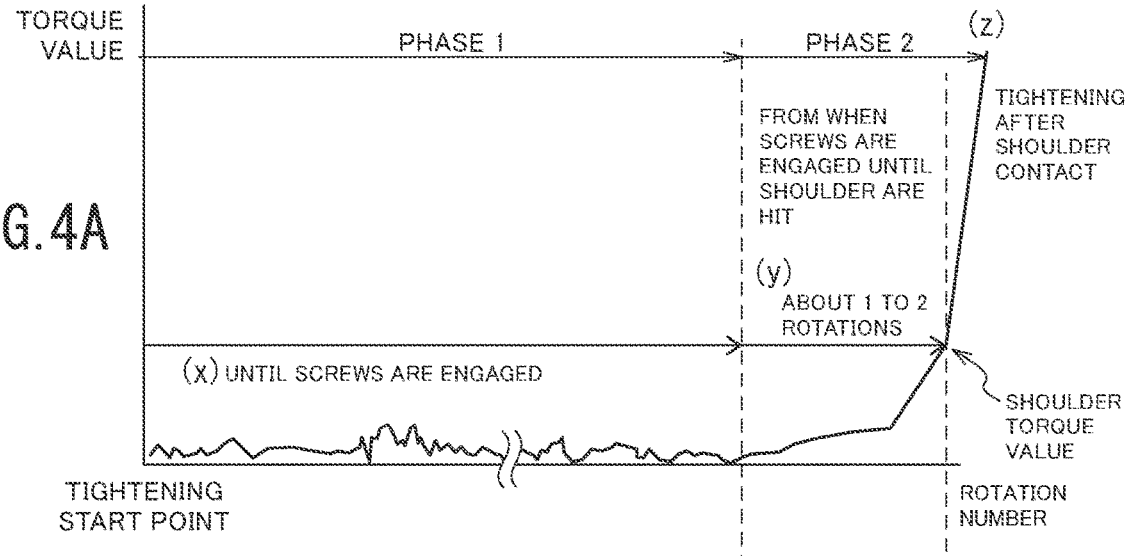
Figure 4B:
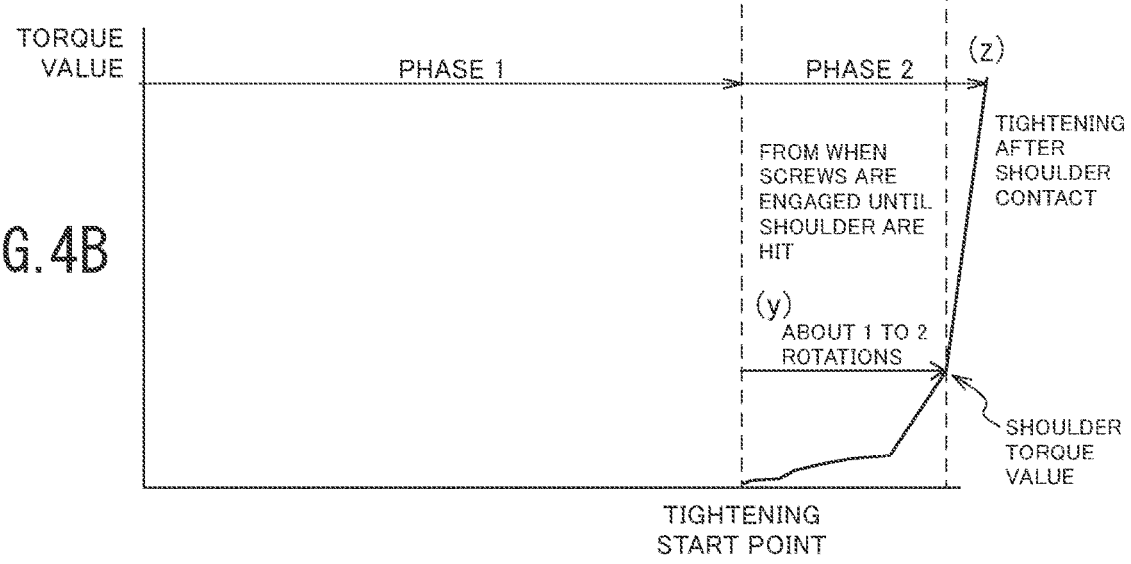

<Regarding FIGS. 4A and 4B>

FIGS. 4A and 4B illustrate FIGS. 2A and 3A in an easily comparable state.

FIG. 4A is an example of FIGS. 2A and 2B, and FIG. 4B is an example of FIGS. 3A and 3B.

According to the study of the inventors, considering the use in the actual well, the ideal solid lubricating coating film is preferred that the solid lubricating coating film is not broken and the possibility of destruction and peeling is minimized in a region (x) of FIG. 4A. Alternatively, the spike may occur somewhat. This is a situation where the solid lubricating coating film is damaged. In this case, it is preferable to design such that the secondary product derived from the solid lubricating coating film in which the film is broken or peeled off does not clog a connection gap in a make-up and break-out process, and conversely, adheres well to the connection to assist lubrication.

Here, it is considered that many past literatures are directed to lubrication (FIG. 4B and FIG. 3A) after the connection are engaged with each other, as determined from a make-up and break-out test result. It is considered to be directed to the lubrication after the threads are engaged with each other, that is, superiority or inferiority of lubrication properties of the solid lubricating coating film itself. Therefore, it is presumed that the short pin is used, and the horizontal tongs or the vertical tongs are used to set the threads until they are engaged with each other by tightening by hand, and then the threads are made up and broken out. Note that, in patent literature specifying the number of make-up times, there is a description that the number of make-up times can be 10 when the diameter is small in make-up in the actual well. This seems to be a possible number of times in evaluation with the short pin or in evaluation with the real well. On the other hand, in the case of a large diameter size of 9 to ⅝" or 13 to ⅜", there are some descriptions that the number of times of make-up and break-out can be up to 15 to 20 times in the make-up and break-out based on the solid lubricating coating film. However, this is very unlikely in the case of large diameters with solid lubricating coating film in the make-up and break-out in the actual well.

In addition, the large-diameter connection for oil country tubular goods has a generally higher make-up torque value, and has more allowance (backlash) between the box connection and the pin connection. Accordingly, the solid lubricating coating film is inevitably broken and peeled off to some extent before the threads are sufficiently engaged with each other. In addition, at the beginning of the test, at the stage of setting the pin connection to the box connection, the weight of the pin is heavy and handling is difficult. Therefore, inadvertent contact of the pin connection with the box connection also occurs at a certain frequency, which also breaks and peels off the solid lubricating coating film.

Then, in the present embodiment, a new laboratory test is devised in view of the situation of make-up and break-out of the actual well, and evaluation by the new laboratory test is also referred to.

Here, a suitable method of simulating the make-up and break-out in the actual well is a method of simulating a make-up behavior that occurs when making up the connection for oil country tubular goods in the actual well. This is used to check the upper and lower limits of the parameters of the present disclosure and to define suitable ranges. It is necessary to determine the evaluation of lubrication of the connection for oil country tubular goods assuming what occurs in the actual well. For this purpose, it is necessary to perform evaluation by simulating what can occur in the actual well or perform evaluation using an actual actual length pin. The process of make-up and break-out the connection for oil country tubular goods can be considered in two stages. The pin connection is inserted into the box connection to be turned as it is or it is turned by hand to some extent until the threads are engaged with each other to avoid cross threads. However, there are a process from when the threads are not completely engaged with each other until the torque rises, that is, until the threads are sufficiently engaged with each other, and a process after the threads are engaged with each other. The former is a situation that is rare in a situation where normal friction and sliding is considered. The latter in which the load is not constant is a situation that is generally assumed when it comes to friction. In the former case, the make-up and break-out is performed at 5 to 25 rpm, and after the torque rises, the make-up and break-out is performed at a low speed rotation of about less than 1 rpm to about 3 rpm at most. In the actual well, the pin is set suspended from above, so that at most the pin's own weight is applied to the box connection. This is called the large load. In addition, the pin is made up and broken out upright when viewed from a distance, but in practice, the make-up and break-out is performed while being eccentric until the threads are sufficiently engaged with each other due to the backlash of the connection. This is called the unbalanced load. Especially in a region where the threads are not engaged with each other, the solid lubricating coating film is easily damaged, and a part thereof is peeled off. Therefore, the solid lubricating coating film itself is designed by the solid lubricant, the binder resin, and other regulations so that the peeled piece does not clog the connection gap or is not seized.

The suitable ranges are defined for the individual components as described above. Further, in the film evaluation, the present invention has been completed by evaluating and determining lubrication based on backlash (allowance) and large load application conditions in accordance with a situation that can occur in the actual well.

(Configuration)

The present embodiment relates to a coating film structure formed on a tightening surface and a threaded joint having the coating film structure as the lubricating coating film, in the connection for oil country tubular goods used for actual oil/gas. The present embodiment is characterized by the lubricating coating film including the solid lubricating coating film formed on the tightening surface of the threaded joint, and a connection structure itself of the threaded joint is not particularly limited. A known or novel connection structure may be adopted as the connection structure of the threaded joint.

<Oil Country Tubular Goods and Threaded Joint for Oil Country Tubular Goods>

Figure 1:
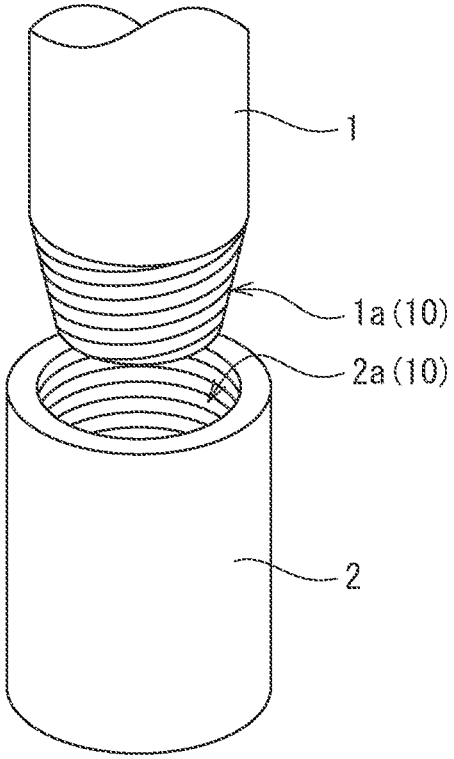
FIG. 1 is a diagram illustrating oil country tubular goods and a threaded joint for oil country tubular goods.

The oil country tubular goods includes, for example, a box 2 such as a coupling and a pin 1 as illustrated in FIG. 1.

As illustrated in FIG. 1, the threaded joint for oil country tubular goods includes the box 2 such as a coupling having a female thread 2*a*, and a pin 1 having a male thread 1*a*. Then, the lubricating coating film including the solid lubricating coating film is formed on a contact surface (tightening surface 10) of a thread portion of at least one component of the box 2 and the pin 1.

Hereinafter, the description will be developed focusing on the box connection (female thread side) and the pin connection (male thread side). The description includes a joint of a T& C (Threaded & Coupled) type of the oil country tubular goods and a joint of an integral type.

<Agent>

Hereinafter, an agent for forming the solid lubricating coating film in the present embodiment will be described.

The agent of the present embodiment is formed by dispersing one or more kinds of solid lubricants in the binder resin as a matrix component.

A main component of the solid lubricant is melamine cyanurate, and the melamine cyanurate has an average particle diameter of 0.1 μm or more and 10.0 μm or less. The main component of the solid lubricant being melamine cyanurate means that, for example, 80 wt % or more, preferably 90 wt % or more of the total weight of the solid lubricant is melamine cyanurate.

The total weight of the solid lubricant is 10 parts by weight or more and 100 parts by weight or less when the total weight of the binder resin is 100 parts by weight.

The binder resin includes an alkyd resin and nitrocellulose. This alkyd resin and nitrocellulose are contained in an amount of 85 wt % or more of the total binder resin component weight.

The weight of the nitrocellulose is preferably 0.5 times or more and 3 times or less the weight of the alkyd resin.

The solvent contained in the agent includes one or more materials selected from mineral spirits, aromatics, alcohols, ester-based solvents, and ketone-based solvents. Examples of the aromatics include mineral spirits, toluene, xylene, naphtha, and benzene. Examples of the alcohols include ethanol, propanol, isopropanol, and butanol. Examples of the ester-based solvent include butyl acetate, methyl acetate, and isobutyl acetate. Examples of the ketone-based solvent include methyl ethyl ketone, methyl isobutyl ketone, cyclohexanone, and acetone.

The weight of the solvent is, for example, 20% or more and 80% or less of the total weight of the solid lubricant and the binder resin.

The oil length of the alkyd resin is, for example, 10 to 60.

Further, the agent may contain a plasticizer. The plasticizer is, for example, one or more materials selected from dibutyl phthalate (DBP), dimethyl phthalate (DMP), and diethyl phthalate (DEP).

When the plasticizer is contained, for example, the plasticizer is contained in an amount of 10 parts by weight or more and 20 parts by weight or less based on 100 parts by weight of the nitrocellulose.

<Coating Film Structure of Connection for Oil Country Tubular Goods>

Hereinafter, the coating film structure of the connection for oil country tubular goods in the present embodiment will be described.

The lubricating coating film including the solid lubricating coating film is formed on the tightening surface of the thread portion of at least one component of the box and the pin. The solid lubricating coating film is formed by dispersing the solid lubricant in the binder resin as the matrix component.

A main component of the solid lubricant is melamine cyanurate, and the melamine cyanurate has an average particle diameter of 0.1 μm or more and 10.0 μm or less.

The binder resin includes an alkyd resin and nitrocellulose. This alkyd resin and nitrocellulose are contained in an amount of 85 wt % or more of the total binder resin component weight.

The total weight of the solid lubricant is 10 parts by weight or more and 100 parts by weight or less based on 100 parts by weight of the total weight of the binder resin, and a thickness of the solid lubricating coating film is 10 μm or more and 150 μm or less.

Figure 7A:
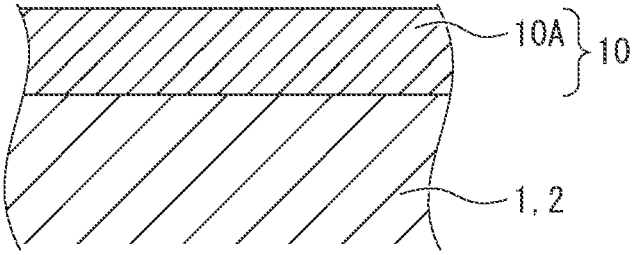
FIG. 7 is a diagram illustrating a coating film structure.
Figure 7B:
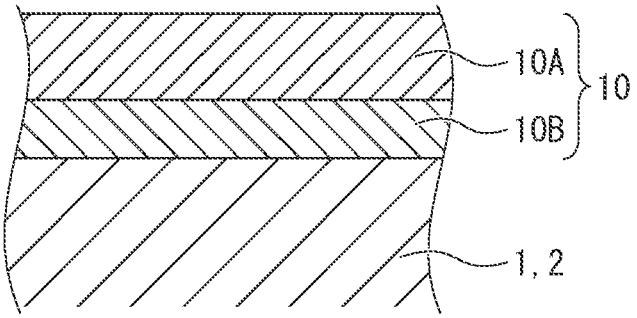

The lubricating coating film may have a base layer 10B between the tightening surface and the solid lubricating coating film (FIG. 7B).

The base layer 10B is made of, for example, a Mn phosphate chemical conversion treatment film, a zinc phosphate chemical conversion treatment film, or an electroplating film containing one or more metals selected from Cu, Sn, and Zn.

The solid lubricating coating film has, for example, a pencil hardness of 2B or more.

<Threaded Joint for Oil Country Tubular Goods>

The lubricating coating film including the solid lubricating coating film is formed on the tightening surface of the thread portion of at least one component of the box and the pin.

Alternatively, the lubricating coating film including the solid lubricating coating film is formed on the tightening surface of the thread portion of one component of the box and the pin. On the other hand, a second solid lubricating coating film softer than the solid lubricating coating film is formed on the tightening surface of the thread portion of the other component of the box and the pin.

The second solid lubricating coating film is formed by, for example, dispersing a second solid lubricant in a second binder resin as the matrix component. The second binder resin contains a fluorine-based organic compound as a main component. The second solid lubricant component includes one or more compounds using a material selected from fatty acids in the following group X and a material selected from metal elements in the following group Y.

Group X: stearic acid, isostearic acid, behenic acid, lauric acid, and 12-hydroxystearic acid Group Y: Li, Na, Mg, Al, Ca, Zn, and Ba As the solvent of the agent for forming the second solid lubricating coating film, for example, a fluorine solvent of the following group Z accounts for 90% or more of the weight of the solvent component.

Group Z: HFC, HFE, and HFO

The second solid lubricating coating film preferably has a pencil hardness of 3B or less.

Here, the inventors simply selected MCA as the solid lubricant, selected a binder resin including nitrocellulose and the alkyd resin as the binder resin, and formed a solid lubricating coating film using them as main components. In this case, when a make-up and break-out test was actually performed, it was found that a mixture of seizure and non-seizure results in a completely unpredictable situation. That is, the lubrication achieved by the conventional lubricating compound cannot be realized simply by combining materials with reference to the disclosed invention groups. Therefore, it is not always possible to reproduce good lubrication even by analogy using the past invention.

Then, in the present embodiment, a new evaluation method of a laboratory test capable of performing evaluation under conditions equivalent to the actual well, which will be described later, was considered, and the test was performed by the evaluation method. Then, with reference to the test results, the present inventors have found the solid lubricating coating film that has further improved seizure resistance and can withstand use in the actual well, and agents, and a preferred range of each agent covering a range expanded to the threaded joint for oil country tubular goods and a metal material, and have completed the present invention.

Further, a detailed description will be given.

<Basic Configuration and Film Thickness of Solid Lubricating Coating Film>

The solid lubricating coating film of the present embodiment is formed by dispersing the solid lubricant mainly containing melamine cyanurate (MCA) in the binder resin including the alkyd resin and nitrocellulose. This combination is suitable as derived from a number of experiments by means of a newly devised new laboratory test.

The reason why MCA was selected as the main component of the solid lubricant is as follows. That is, this is because the MCA is excellent as the lubricant capable of obtaining high lubrication, and high lubrication can be maintained even when the temperature locally reaches a high temperature due to slight seizure. At the time of make-up and break-out, the pin connection and the box connection may rub against each other to generate frictional heat, but even in this case, the MCA can maintain sufficient lubrication.

The binder resin including the alkyd resin and nitrocellulose was selected for the following reasons. The choice of the alkyd resin and nitrocellulose is so-called horizontal development of the technology from a lacquer paint. The lacquer paint has a feature that it can be cured even without heat treatment at normal temperature and normal pressure if an alkyd resin having an appropriate oil length is selected. This is because film formation can be easily performed, and overcoating can also be performed. Furthermore, this is because there is no particular problem even if the above-described MCA is mixed in the lacquer paint.

The binder resin is preferably a film as hard as possible. Desirably, the pencil hardness is about HB to 2H. In addition, it is necessary to overcome brittleness so as not to cause peeling (complete peeling) in which most of the binder resin is taken away, rather than peeling in which the binder resin is shaved off little by little.

The film thickness of the solid lubricating coating film needs to be at least 10 μm. When the film thickness is 10 μm or more, the lubricating properties can be maintained and the anticorrosion properties can be maintained. The upper limit of the film thickness is difficult to say unconditionally because the gap between the box connection and the pin connection varies depending on the type and design of the connection for oil country tubular goods. In the present embodiment, for example, the upper limit is 150 μm. Since many connection for oil country tubular goods are designed such that the gap between the threads is about 100 to 200 μm, the upper limit of the gap is set to 150 μm. The film thickness is more preferably 10 to 50 μm.

Here, a gap between a thread and a root of the male thread and the female thread may be 100 to 200 μm as described above. However, a gap between stabbing flanks and a gap between load flanks between the male thread and the female thread vary between the time of tightening and the time of loosening. When the gap is reduced, it is almost in close contact. Therefore, the film thickness is preferably small, and is preferably in the range of 10 μm to 50 μm. However, these film thicknesses mean the film thicknesses in the as-formed state before the first make-up. At the time of make-up and break-out, since the binder resin is somewhat shaved, and the film thickness applied at room temperature actually collapses and becomes a thin film, and thus even if there is a thickness equal to or larger than the gap assumed in the actual well, there is no problem that the seizure occurs due to this reason.

<Solid Lubricant>

One or more solid lubricants are contained. Among the solid lubricants, melamine cyanurate (MCA) is contained in an amount of 80 wt % or more. The average particle diameter of melamine cyanurate is 0.1 to 10.0 μm.

In the present embodiment, a solid lubricant containing MCA as a main component is dispersed in the binder resin. Then, the components of the present disclosure are that when the total weight of the solid lubricant is the denominator, the MCA accounts for 80% and the average particle diameter of MCA is 0.1 μm or more and 10.0 μm or less. These definitions cannot always create a highly lubricated condition in the broad sense of the MCA. Therefore, it means that, in order to achieve high lubricity, the MCA dispersed in an epoxy resin, which is the binder resin used in a use environment of the connection for oil country tubular goods and used in the present disclosure, is optimal and significantly high lubricity can be expected when used in this range.

The average particle diameter of MCA is preferably as small as possible. Note that the average particle diameter is a parameter that means a particle diameter at an integrated value of 50% in a particle size distribution obtained by a laser diffraction/scattering method or the like.

As a still more preferred range, the average particle diameter of MCA is preferably 2 μm or less. When MCA having an average particle diameter of 2 μm or less is selected, coarse MCA of about 10 to 20 μm may be contained very rarely. The more preferred range is determined in order to eliminate the possibility that the seizure may occur due to mixing of coarse MCA.

That the MCA is 80 wt % or more of the solid lubricant means that the MCA occupies a main stream of the solid lubricant. In addition, when the total weight of the solid lubricant is the denominator, even if the solid lubricant contains about less than 20% of other solid lubricants, it is defined in the sense that there is no adverse effect in the MCA-based design.

In the present disclosure, it is better as the proportion of MCA in the solid lubricant is higher. Since lubricity may be deteriorated due to mixing of other components in MCA, the range in which MCA is mainly handled was set to 80% or more. As other solid lubricants that can be assumed to be mixed at up to less than 20%, for example, BN having the same white tone, PTFE having excellent lubricity, and the like can be considered. Further, examples of other solid lubricants include graphite, fluorographite, $MoS_2$, $WS_2$, mica, and talc.

In addition, an oil-based substance may be mixed as a kind of solid lubricant. For example, carvana wax, PFPE oil (perfluoropolyether), CTFE oil (low polymer of chlorotrifluoroethylene), or the like may be mixed. By mixing the oil-based substance, lubrication of the MCA can be maintained or improved.

<Binder Resin Component>

The alkyd resin and nitrocellulose are contained as the binder resin component, and this combination is contained in an amount of 85 wt % or more of the total binder resin component weight. The proportion of the nitrocellulose is preferably 0.5 times or more and 3 times or less the weight of the alkyd resin.

Further, the alkyd resin preferably has an oil length of 10 to 60.

As a plasticizer, for example, one or two or more kinds of phthalic acid esters may be mixed. In this case, the content of the phthalic acid ester is preferably 10 parts by weight or more and 20 parts by weight or less when the weight of the nitrocellulose is 100 parts by weight. Note that examples of the phthalate ester candidate include dibutyl phthalate (DBP), dimethyl phthalate (DMP), and diethyl phthalate (DEP).

In the present embodiment, a so-called nitrocellulose lacquer was used as a component of the binder resin. The nitrocellulose lacquer is obtained by dissolving compatible nitrocellulose and the alkyd resin in a quick-drying solvent. When it is applied, the solvent evaporates on the applied surface, and a hard film is obtained. The film made of nitrocellulose lacquer is a hard film, but is accompanied by brittleness, and therefore needs to be flexible to some extent.

The alkyd resin is added to improve the film quality. In this case, the alkyd resin is 0.5 times or more and 3 times or less the weight of the nitrocellulose component. When the alkyd resin is less than 0.5 times, brittle property stands out. Then, the complete peeling is likely to occur at the time of make-up and break-out the connection for oil country tubular goods, and as a result, the seizure tends to occur. If the alkyd resin exceeds 3 times, a small crack is likely to occur in the binder resin film.

In the present embodiment, it is assumed that when the agent is applied, the agent is formed into a film by natural drying as a main use situation. Therefore, the alkyd resin preferably has an oil length of 10 or more and less than 60. If the oil length is less than 10, heat treatment is required to form the film. If the oil length exceeds 60, the viscosity is too high, and there is a possibility that lumps are formed at the time of brush coating or spray coating, and uniform coating cannot be performed. In addition, a large oil length is not preferred because it directly leads to a reduction in strength of the alkyd resin.

Further, as described above, nitrocellulose is hard but brittle. Therefore, the alkyd resin is mixed to form the resin film. Furthermore, in order to overcome brittleness, it is preferable to mix one or more kinds of phthalic acid esters as the plasticizer. The plasticizer may be contained in an amount of 10 parts by weight or more and 20 parts by weight or less when the weight of the nitrocellulose is 100 parts by weight. Even with such a degree of content, the crack on the surface can be minimized.

On the other hand, the nitrocellulose has a property of being weak against ultraviolet rays. Therefore, it is preferred that the surface provided with the solid lubricating coating film is not directly exposed to sunlight. Therefore, it is preferable to form the solid lubricating coating film on the box connection side. When the solid lubricating coating film of the present embodiment is applied to the pin connection side, it is recommended that the solid lubricating coating film be used with a protector attached.

Further, in any case, in order to prevent ultraviolet rays, it is also allowable to add an oxybenzone-based agent having ultraviolet absorbing capability in a trace amount of 5 parts by weight or less when the weight of the nitrocellulose is 100 parts by weight.

In addition, an additive for adjusting the drying property and liquid viscosity of the entire agent and adjusting the hardness when the solid lubricating coating film is formed, and a solvent that does not remain in the solid lubricating coating film after drying may be contained.

<Regarding Solvent>

The agent contains a solvent.

The solvent includes, for example, one or more kinds among mineral spirits, toluene, xylene, naphtha, benzene, and alcohols such as ethanol, propanol, isopropanol, and butanol.

In the present embodiment, a quick-drying property of the applied agent is intended. Therefore, it is preferable to dissolve a coating film component (nitrocellulose, alkyd resin, MCA, or the like) in a highly volatile organic solvent. The quick-drying property referred to herein refers to performance of curing the film by natural leaving for about 5 minutes. In some situations, air blowing or the like may be used in combination at the time of film formation.

The weight of the solvent is preferably 20% or more and 80% or less based on the total weight of the binder resin mainly containing the nitrocellulose and the alkyd resin and the solid lubricant mainly containing the MCA. If it exceeds 80%, the agent solution itself is thin and difficult to apply, and it takes too much drying time. This is because it is difficult to use. Further, if it is less than 20%, the viscosity of the solution increases too much, and it is difficult to apply the solution uniformly.

<Mixing Ratio of Solid Lubricant and Binder Resin>

The total weight of the solid lubricant is 10 parts by weight or more and 100 parts by weight or less based on 100 parts by weight of the total weight of the binder resin. When the weight of the entire binder resin mainly containing the nitrocellulose and the alkyd resin is 100 parts by weight, it is necessary to define the solid lubricant mainly containing the MCA as described above.

When the amount of the solid lubricant is less than 10 parts by weight, the amount of the lubricant is too small to realize appropriate lubrication, and the seizure occurs early. Conversely, when the amount of the solid lubricant exceeds 100 parts by weight, there is too much solid lubricant. That is, when the amount of the solid lubricant embedded in the binder resin containing the nitrocellulose and the alkyd resin is too large, the binder resin itself is brittle. Then, peeling of the coating film is more than necessary at the time of make-up, and the possibility of seizure increases. Therefore, it is necessary to adjust to the above range.

<Film Hardness of Solid Lubricating Coating Film>

The solid lubricating coating film preferably has a pencil hardness of 2B or more. Assuming the lubrication behavior of the solid lubricating coating film in the actual well, the solid lubricating coating film tends to be easily damaged during the behavior until the threads are engaged with each other, that is, when the connection for oil country tubular goods is made up in a backlash state. However, the damage is minimized by hardening the film quality. Specifically, the solid lubricating coating film is prevented from being shaved by the hard film of 2B or more.

In the present embodiment, the solid lubricating coating film is a hard film. Thus, the film maintains lubrication as a film quality that is not brittle so as not to be completely broken at the time of make-up. Therefore, the nitrocellulose and the alkyd resin are used as main components, and the hardness of the binder resin may be adjusted to be a hard film of 2B or more. This adjustment of the hardness can be achieved by the ratio of nitrocellulose to the alkyd resin, and the particle size and the concentration of the MCA, as described above.

The pencil hardness evaluation is measured by a method specified in JIS K 5600-5-4 (1999). It is clearly stated in the JIS standard that this standard is a translation of the "ISO/DIS 15184, Paints and varnishes-Determination of film hardness by pencil test" standard. However, the pencil hardness test method itself was evaluated based on the definition in the JIS standard. In addition, the reason why the film hardness was evaluated by the pencil hardness is that the pencil hardness test method is the pencil "scratch" evaluation, and the film hardness evaluation method is based on "scratch", which is similar to the behavior of peeling the solid lubricating coating film with the male thread and the female thread of the connection for oil country tubular goods. In the film hardness measurement method, Rockwell, Vickers, Shore, and Knoop, which are sometimes used in a coating film or the like, the coating film is thin and affected by a base, the pencil hardness was used in the present disclosure.

Other Definitions

A solid lubricating coating film 10A may be formed directly on a base steel material (the tightening surface) (see FIG. 7A).

Alternatively, as illustrated in FIG. 7B, the solid lubricating coating film may be formed after the base layer 10B is formed. The adhesion of the solid lubricating coating film can be increased by providing such a base layer.

Examples of the base layer 10B include the Mn phosphate chemical conversion treatment film, the zinc phosphate chemical conversion treatment film, and the electroplating film containing one or more metals selected from Cu, Sn, and Zn.

<When the Solid Lubricating Coating Film is Formed Only on One Side of One of Tightening Surfaces Facing Each Other>

The solid lubricating coating film may be formed on both the pin connection and the box connection of the connection for oil country tubular goods, or may be formed on only one of them.

When the solid lubricating coating film is formed only on one side, the tightening surface of the other connection may be cut or shot blasted. Alternatively, a soft second solid lubricating coating film may be formed on the tightening surface of the other connection.

<Second Solid Lubricating Coating Film>

The second solid lubricating coating film is formed by, for example, dispersing a second solid lubricant in a second binder resin as the matrix component.

The second binder resin contains a fluorine-based organic compound as a main component.

The second solid lubricant component includes one or more compounds using a material selected from fatty acids in the following group X and a material selected from metal elements in the following group Y.

Group X: stearic acid, isostearic acid, behenic acid, lauric acid, and 12-hydroxystearic acid Group Y: Li, Na, Mg, Al, Ca, Zn, and Ba As the solvent of the agent for forming the second solid lubricating coating film, for example, a fluorine solvent of the following group Z accounts for 90% or more of the weight of the solvent component.

Group Z: HFC, HFE, and HFO

The second solid lubricating coating film preferably has a pencil hardness of 3B or less. The above-mentioned solid lubricating coating film is hard with a pencil hardness of 2B or more, whereas the second solid lubricating coating film is preferably softer than that, as follows. That is, contact between a hard film and a soft film can achieve more preferable friction than contact between hard films. Specifically, since it can be expected that the solid lubricant is constantly gradually exposed and supplied while the soft film is shaved, low friction is easily realized.

<Method for Evaluating Lubrication Properties>

The present embodiment defines each material from the viewpoint of realizing lubrication properties that can withstand an environment that can occur in the actual well. In addition, when the upper and lower limits are defined, they are determined by performing verification (test) under conditions conforming to the make-up and break-out conditions in the actual well.

In the horizontal type and vertical type power tong method using the short pin as performed in a normal laboratory test, the make-up and break-out conditions do not conform to actual conditions, and in the case of the solid lubricating coating film, the conditions will be loose. Therefore, it is meaningless to describe the definition of the upper and lower limits of each material by evaluation in the normal laboratory test. Unless the conditions are not so high, the number of times of make-up and break-out is determined to be pass. In the present disclosure, a new laboratory test capable of simulating a situation in the actual well was devised, and was evaluated under conditions conforming to the actual well in the new laboratory test. The new laboratory test is also referred to as a weight tong test.

<Test Method Simulating Actual Well Test Condition (New Laboratory Test (Weight Tong Test))>

In the present embodiment, as described with reference to FIGS. 2A to 4B, the phenomenon caused by lubrication of the connection for oil country tubular goods is considered in two stages of before (phase 1) and after (phase 2) the threads are engaged with each other. Then, in consideration of the make-up and break-out (lubrication) at a first stage (phase 1), a method of comprehensively evaluating connection lubrication including the lubrication at a second stage (phase 2) was considered.

If this evaluation is not performed, although it is OK in the evaluation of the laboratory test, troubles may frequently occur in the actual well. In the actual well, the large load and the unbalanced load are applied until the threads are engaged with each other. Therefore, the solid lubricating coating film may be damaged or peeled off, and in severe cases, the solid lubricating coating film may be completely peeled off. Based on this, the upper and lower limits of the preferred range were selected for the parameters of the present embodiment.

As described above, in the case of the solid lubricating coating film, damage to the film cannot be avoided by tightening or the like until the threads are engaged with each other. Then, the secondary product is formed based on the peeled product. If this clogs the connection gap, the seizure occurs. Therefore, if the lubrication evaluation is not performed under the conditions conforming to the actual well, there is a possibility that even the solid lubricating coating film that is actually at a failure level is erroneously determined to be pass. When the evaluation is based on such an optimistic evaluation, it is meaningless to limit upper and lower limits of parameters related to the solid lubricating coating film and to select suitable ranges.

That is, on the premise of damage or peeling of the solid lubricating coating film, if it is not considered whether the secondary product formed based on the solid lubricating coating film, that is, the "secondary product" to be reconstituted affects lubrication, an accurate solid lubricating coating film cannot be obtained. In the present embodiment, the evaluation by the new laboratory test that takes into account such findings is performed.

It is to be noted that if the evaluation with horizontal power tongs using the short pin or the evaluation with vertical power tones using the short pin (evaluation by the conventional laboratory test) is relied on, there is no meaning in the evaluation of the solid lubricating coating film. In the past patent literature, in the lubrication test based on the solid lubricating coating film, even in the case of a large diameter size of 9 to ⅝" or 13 to ⅜", there are some descriptions that the number of times of make-up and break-out can be up to 15 to 20 times. The result shows that the lubrication is slightly inferior to that of the grease-like compound, but the number of times is substantially unlikely in the solid lubricating coating film. These appear to be due to the horizontal or vertical power tong type evaluation using the short pin, which are often seen in the conventional laboratory test. In the case of large diameters with solid lubricating coating film in the make-up and break-out in the actual well, 15 to 20 times level is very unlikely.

Figure 5:
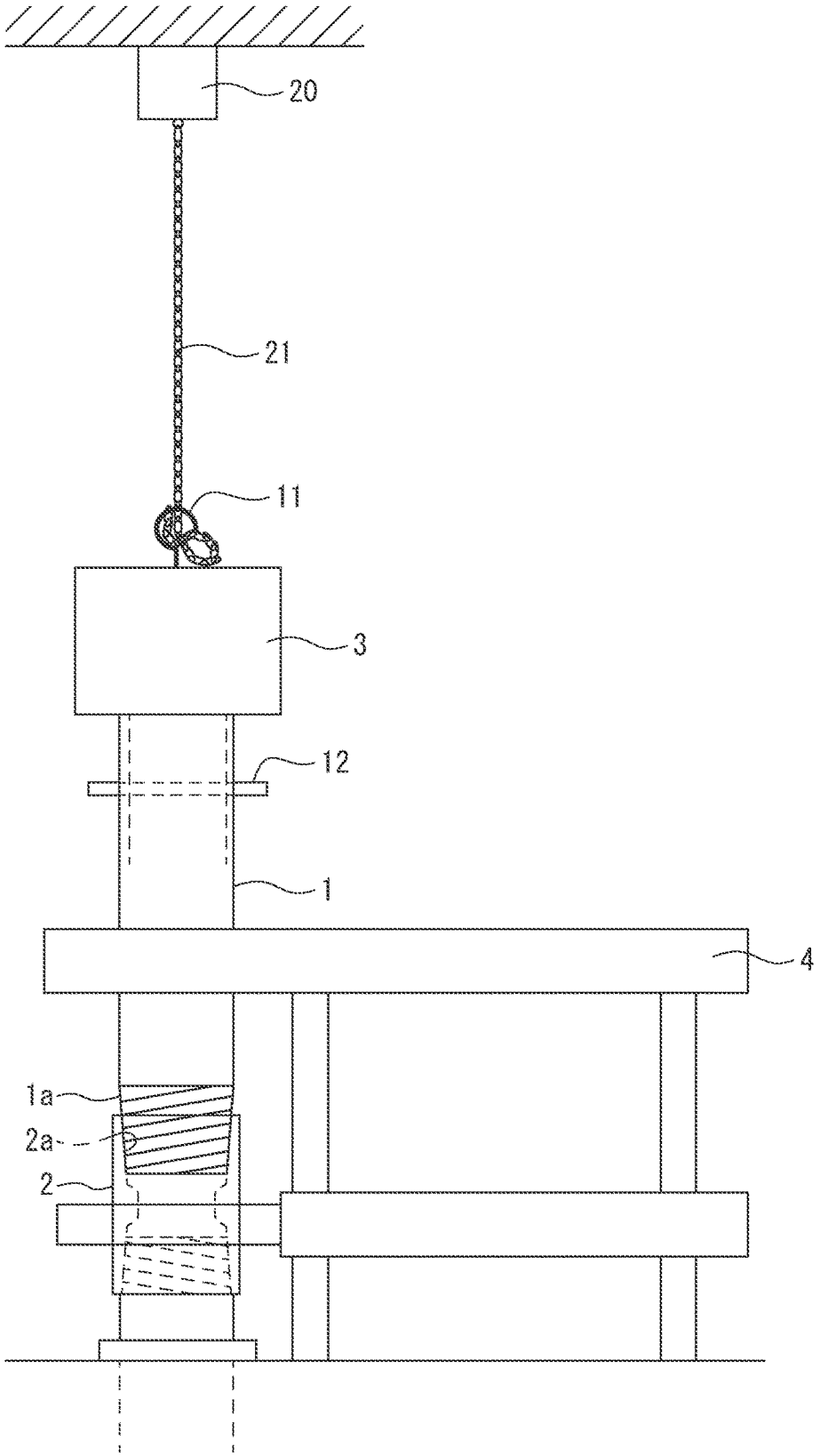
FIG. 5 is a diagram for illustrating a new laboratory test (weight tong test)

In the present embodiment, the test was performed with the device configuration illustrated in FIG. 5 based on the conditions of the new laboratory test.

The new laboratory test is based on evaluation under conditions that can realize the large load at the time of make-up and an unbalanced load condition at the time of make-up and break-out. For example, in the case of a process in which the large load equivalent to the actual pin is applied to the joint portion and the threads are tightened, the backlash until the threads are engaged with each other is considered. In addition, in the case of a process of loosening the threads, the point that the threads are disengaged from each other and the backlash occurs is reflected.

In the new laboratory test, a vertical power tong 4 is used. In addition, a short pin 1 is employed as a test pin. However, it is possible to apply a load to an upper portion of the pin 1 by a weight 3 and remove the load.

Then, a short connection 1 and a box connection 2 are tightened by a pin thread portion 1*a* and a box thread portion 2*a*.

At this time, in order to simulate a situation in which the threads are not engaged with each other, the initial temporary make-up position is set such that half of the total number of threads of a pin connection 1*a* is exposed from the box connection 2 (see FIG. 2B). This is one of the causes of backlash. From this state, the make-up is started.

At the time of make-up, the weight 3 is attached to an upper end portion of the pin 1, which is an end portion opposite to the tightening threads of the box connection 1.

The weight of the weight 3 is calculated based on the actual pin having the outer diameter and thickness of the pin, as a load corresponding to one to three actual pins. If it is 9 to ⅝" 53.5 #, the load is about 1 t per one (2,200 Lb), and if it is equivalent to three connections, the load is about 3 tons (6,600 Lb).

Figure 6:
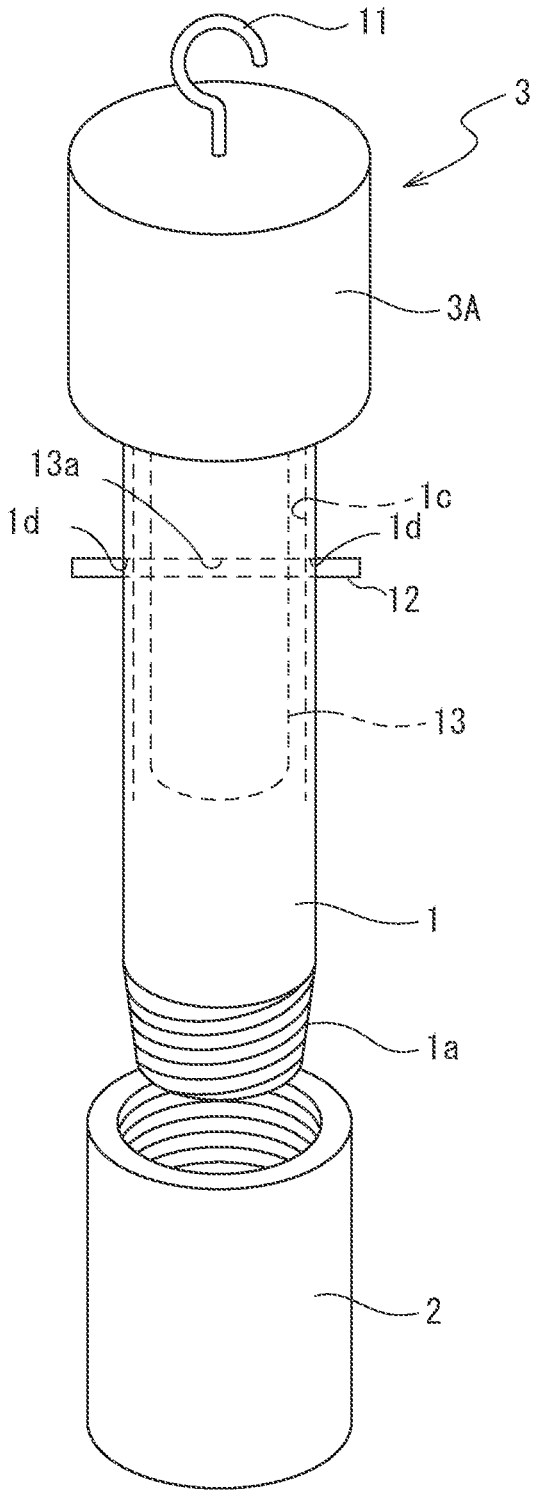
FIG. 6 is a diagram illustrating an installation example of a weight in the new laboratory test (weight tong test)

As illustrated in FIG. 6, the weight 3 illustrated in FIG. 5 includes a weight body 3A and an insertion rod 13. The insertion rod 13 is joined to a lower surface of the weight body 3A by welding, and is disposed at an axisymmetric position of the weight 3. By inserting the insertion rod 13 into the pin 1 in a loosely inserted state, the weight is attached to the pin. Reference numeral 1*c* denotes an inner diameter surface of the pin 1.

When the weight 3 is attached to the insertion rod 13 and the pin 1 as described above, holes 1*d* and 13*a* penetrating the pin 1 and the insertion rod 13 are formed in advance. Then, as illustrated in FIG. 6, the weight 3 and the pin 1 are integrated by inserting a penetrating rod 12 into the holes 1*d* and 13*a*.

A hook 11 of a free hook (swivel) type is attached to an axial center position of an upper portion of the weight 3 by welding, and is suspended from a ceiling suspension device 20 via a suspension chain 21. Thus, the magnitude of the load of the weight on the pin can be adjusted by adjusting the suspension level of the weight by the suspension device 20.

Then, at the time of make-up, the suspension chain 21 is loosened, a weight load is applied to the box connection, and the make-up is performed at 5 to 20 rpm until the torque rises (phase 1). This is a simulation of the backlash. Once the torque has risen, the rotational speed is reduced to 0.5 to 2 rpm and the make-up is performed up to the make-up position (phase 2).

On the other hand, when loosening (breaking out), the weight 3 is lifted by the suspension device 20, and the break-out is performed in a state where the load of the weight 3 is not applied. As for the rotational speed, when the torque is rising, the rotation speed is started to be loosened at 0.5 to 2 rpm, and when the torque reaches about 1/10 of the make-up torque value, the rotational speed is loosened at high speed rotation of 5 to 20 rpm.

Here, a condition close to an actual well environment is obtained when the load is not applied at the time of loosening. This is a finding based on an experimental fact that the evaluation of the lubrication properties was better in the case of applying the load of the weight 3 than in the case of not applying the load. That is, as a result of actually observing the experiment, the inventors have obtained a finding that when the weight is loosened in a state where the weight is applied, the weight becomes a balancer, and the pin is loosened straight from a make-up completion position without backlash. On the other hand, a case where the weight is reduced, that is, a case where the test is performed while the load is lifted so that the weight load becomes zero is assumed. In this case, it has been found that the test can be performed under a condition in which the backlash is more severe and the solid lubricating coating film tends to be damaged, by a condition in which the threaded joint is loosened by reducing the load including a condition in which the load is not completely zero.

In the new laboratory test under the above conditions, it is possible to simulate a situation in which the secondary product from a solid lubricating coating film-derived component that is released into the connection gap due to inevitable peeling or the like does not move following the make-up and break-out and clogs at a certain location, to cause seizure. Alternatively, another situation can be simulated in which the coating film itself is completely peeled off. As a result, the upper and lower limits of the parameters related to the solid lubricating coating film can be defined conforming to actual well conditions. The evaluation was performed by a method in which after completion of the break-out, the pin connection and the box connection were separated from each other, fragments and the like derived from the solid lubricating coating film present on the surface were removed by air blowing to check the surface, and the make-up is continued again.

The present embodiment defines components and the like in order to realize the lubrication properties that can withstand the environment that may occur in the actual well. In addition, when the upper and lower limits are defined, they are determined by performing verification under the conditions conforming to the make-up and break-out conditions in the actual well.

Effects

In the present embodiment, in the field of lubrication using the solid lubricating coating film of the connection for oil country tubular goods, it is possible to simultaneously realize high lubricity and corrosion resistance that withstand the make-up in the actual well. At this time, the present embodiment simultaneously achieves high lubricity and corrosion resistance on the premise that the main component of the solid lubricant is MCA and the main components of the binder resin component are the nitrocellulose and the alkyd resin.

The solid lubricating coating film of the present embodiment can realize the lubrication properties and the anticorrosion properties comparable to those of the grease-like compound for lubrication, a rust preventive grease-like compound for storage, and an oily rust preventive material, which have been conventionally used.

In addition, in the present embodiment, the molecular weights of the binder resin and the solid lubricant constituting the solid lubricating coating film is also defined, so that it is possible to obtain the lubricating performance at the time of make-up comparable to that of the conventional connection for oil country tubular goods without using the conventional compound.

In the present invention, for example, the threaded joint for oil country tubular goods having lubricating performance during make-up can be obtained in consideration of actual well equivalent conditions that may occur in the actual well environment. Note that the conditions equivalent to the actual well are conditions in which a pin weight (the large load) is applied to the box from above, a load (the unbalanced load) is applied obliquely due to a deviation of the axial center, and the load is applied locally rather than uniformly in many cases, or the like.

Furthermore, the application may be expanded not only to lubrication of the connection for oil country tubular goods but also to other metal materials. In addition, not only the film but also the agent for forming the film are also targeted.

Others

The present disclosure can also have the following configurations.

(1) An agent for forming a solid lubricating coating film on a thread portion of oil country tubular goods, in which a solid lubricant is dispersed in a binder resin, a main component of the solid lubricant is melamine cyanurate, and an average particle diameter of the melamine cyanurate is 0.1 μm or more and 10.0 μm or less, the binder resin contains an alkyd resin and nitrocellulose, and the alkyd resin and nitrocellulose are contained in an amount of 85 wt % or more of the total binder resin component weight, and a total weight of the solid lubricant is 10 parts by weight or more and 100 parts by weight or less based on 100 parts by weight of a total weight of the binder resin.

(2) A weight of the nitrocellulose is 0.5 times or more and 3 times or less a weight of the alkyd resin.

(3) A solvent is included, in which the solvent contains one or more materials selected from mineral spirits, aromatics, alcohols, ester-based solvents, and ketone-based solvents, and a weight of the solvent is 20% or more and 80% or less of the total weight of the solid lubricant and the binder resin.

(4) An oil length of the alkyd resin is 10 to 60.

(5) The agent contains: one or more materials selected from dibutyl phthalate (DBP), dimethyl phthalate (DMP), and diethyl phthalate (DEP) as a plasticizer; and the plasticizer in an amount of 10 parts by weight or more and 20 parts by weight or less when a weight of the nitrocellulose is 100 parts by weight.

(6) Oil country tubular goods with a lubricating coating film including a solid lubricating coating film formed on a thread portion, in which the lubricating coating film including the solid lubricating coating film is formed on a tightening surface of a thread portion of at least one component of the box and the pin, the solid lubricating coating film includes a solid lubricant dispersed in a binder resin, a main component of the solid lubricant is melamine cyanurate, and an average particle diameter of the melamine cyanurate is 0.1 μm or more and 10.0 μm or less, the binder resin contains an alkyd resin and nitrocellulose, and the alkyd resin and nitrocellulose are contained in an amount of 85 wt % or more of the total binder resin component weight, the total weight of the solid lubricant is 10 parts by weight or more and 100 parts by weight or less with respect to 100 parts by weight of the total weight of the binder resin, and a thickness of the solid lubricating coating film (including the binder resin, the solid lubricant, other additives, and the like) is 10 μm or more and 150 μm or less.

(7) The lubricating coating film includes a base layer between a tightening surface of the thread portion and the solid lubricating coating film, and the base layer includes a Mn phosphate chemical conversion treatment film, a zinc phosphate chemical conversion treatment film, or an electroplating film containing one or more metals selected from Cu, Sn, and Zn.

(8) The solid lubricating coating film has a pencil hardness of 2B or more.

(9) A threaded joint for oil country tubular goods connecting a box having a female thread and a pin having a male thread, in which at least one oil country tubular goods of the box and the pin includes the oil country tubular goods on which the lubricating coating film is formed according to the present disclosure.

(10) The lubricating coating film including the solid lubricating coating film is formed on a tightening surface of a thread portion of one of the box and the pin, and a second solid lubricating coating film that is softer than the solid lubricating coating film is formed on a tightening surface of a thread portion of the other of the box and the pin.

(11) The second solid lubricating coating film is formed by dispersing a second solid lubricant in a second binder resin, the second binder resin contains a fluorine-based organic compound as a main component, the second solid lubricant contains one or more compounds using a material selected from fatty acids in the following group X and a material selected from metal elements in the following group Y.

Group X: stearic acid, isostearic acid, behenic acid, lauric acid, and 12-hydroxystearic acid Group Y: Li, Na, Mg, Al, Ca, Zn, and Ba (13) The second solid lubricating coating film has a pencil hardness of 3B or less.

EXAMPLES

Next, an example based on the present embodiment will be described.

First, pass determination criteria of the lubrication behavior based on the number of times of make-up and break-out will be described. The determination criteria are as follows. As for a casing size, the make-up and break-out of three times or more was determined to be pass and five times were determined to be better. As for a tubing size, 5 times or more was determined to be pass, and 10 times or more was evaluated as more excellent. The casing size is specified in accordance with ISO13679. On the other hand, as for tubing, 5 times or more, which is lower than the regulation of ISO13679, was considered to be pass. Because of the solid lubricating coating film, it is clear that the number of times of make-up and break-out tends to be worse than that of lubrication using the conventional grease-like compound, and this is being recognized by the oil and gas industry as well. As described above, if the make-up and break-out test is performed from the point where the threads are engaged with each other simply using the short pin, the regulation of ISO 13679 would be an easy target, however, the present disclosure performs evaluation by the new laboratory test (weight tong test) to simulate a condition of the large load and the unbalanced load and the condition with backlash in which the threads are not engaged with each other, which is close to a condition that can actually occur in the well, and thus the criteria was used.

The applied load by the weight tongs was performed using a weight 1 ton load with a load as 1 ton load of an actual size of 9 to ⅝". Then, the weight was attached to the upper portion of the pin connection.

The make-up was performed from a state where the connection was tightened only up to a position where half of the total number of pin threads are exposed from the box connection, that is, the threads were not engaged with each other.

That is, the present example was performed by the device illustrated in FIGS. 5 and 6.

In addition, a load of the weight is applied at the time of make-up. On the other hand, at the time of break-out, the test was performed in a state in which the load of the weight was devised so as not to be applied. If the test is performed under the load at the time of break-out, in a case where a pin in which the short pin and the weight are integrated is used, the short pin integrated with the weight rises straight from the make-up position, unlike the actual size pin in the actual well. Since the weight serves as a balancer, the backlash does not occur. The pin employed in the actual well is slightly bent because it is long. Therefore, as the pin gradually swings and the threads are not engaged with each other, the backlash occurs and there is a high tendency to break the solid lubricating coating film.

Therefore, in the lubrication evaluation using the weight tongs, the load was not applied at the time of break-out, when it was close to a situation where the threads were not engaged with each other, the backlash that occurred in conjunction with the break-out was simulated. In addition, not applying the load does not necessarily mean that the load is zero. The weight was lifted with an overhead crane or the like and tested so as not to apply the load. Note that the test of checking the number of times of make-up and break-out using the weight tongs was performed twice or more. Then, whether the number of times reached the pass criteria and how much the number of passes was compared with the test score and evaluated, and whether the parameter was pass was determined.

Example 1

In Example 1, the evaluation of the lubrication properties using the weight tongs will be described.

The conditions and evaluation results of the examples are described in Tables 1 to 4. Note that the solid lubricating coating film is also referred to as a coating film. Further, the second solid lubricating coating film is also referred to as the coating film of the soft film.

TABLE 1

| | Steel type | OD (inch) | WT (LPF) | Screw type | Side where the slolid lubication coating film is formed | Base film and base treatment | Solid lubricant: Fraction of MCA Fraction of other lubricants | Solid lubricant: Average particle diameter of MCA (μm) | Weight ratio of total solid weight agent and total binder resin ※When total weight of all binder resins is 100 parts by weight |
|---|---|---|---|---|---|---|---|---|---|
| 1 | Q125 | 9⅝" | 53.5# | JFELION ™ | CPLG Screw PIN Screw | MnPhos — | MCA: 100% | 5 | 40 pbr |
| 2 | Q125 | 9⅝" | 53.5# | JFELION ™ | CPLG Screw PIN Screw | MnPhos — | MCA: 100% | 5 | 40 pbr |
| 3 | Q125 | 9⅝" | 53.5# | JFELION ™ | CPLG Screw PIN Screw | MnPhos — | MCA: 100% | 5 | 40 pbr |
| 4 | Q125 | 9⅝" | 53.5# | JFELION ™ | CPLG Screw PIN Screw | MnPhos — | MCA: 100% | 5 | 40 pbr |
| 5 | Q125 | 9⅝" | 53.5# | JFELION ™ | CPLG Screw PIN Screw | MnPhos — | MCA: 100% | 5 | 40 pbr |
| 6 | Q125 | 9⅝" | 53.5# | JFELION ™ | CPLG Screw PIN Screw | MnPhos — | MCA: 100% | 5 | 40 pbr |
| 7 | Q125 | 9⅝" | 53.5# | JFELION ™ | CPLG Screw PIN Screw | MnPhos Shot blasted | MCA: 100% | 5 | 40 pbr |
| 8 | Q125 | 9⅝" | 53.5# | JFELION ™ | CPLG Screw PIN Screw | MnPhos Shot blasted | MCA: 100% | 5 | 40 pbr |

TABLE 1-continued

| | Binder resin (Alkyd + Nitrocellulose) | | | Solvent | |
|---|---|---|---|---|---|
| | Rate to total binder resin (%) | Weight ratio of nitrocellulose to alkyd resin | Oil length of alkyd resin | Medicine type | Blending ratio to total weight of solid lubricant and binder resin before film is formed (%) |
| 1 | 100 | 2.0 | 50 | Toluene: 60%<br>Butyl acetate: 20%<br>Cyclohexanone: 10%<br>Methyl ethyl ketone: 10% | 50 |
| 2 | 100 | 2.0 | 50 | Toluene: 60%<br>Butyl acetate: 20%<br>Cyclohexanone: 10%<br>Methyl ethyl ketone: 10% | 50 |
| 3 | 100 | 2.0 | 50 | Toluene: 60%<br>Butyl acetate: 20%<br>Cyclohexanone: 10%<br>Methyl ethyl ketone: 10% | 50 |
| 4 | 100 | 2.0 | 50 | Toluene: 60%<br>Butyl acetate: 20%<br>Cyclohexanone: 10%<br>Methyl ethyl ketone: 10% | 50 |
| 5 | 100 | 2.0 | 50 | Toluene: 60%<br>Butyl acetate: 20%<br>Cyclohexanone: 10%<br>Methyl ethyl ketone: 10% | 50 |
| 6 | 100 | 2.0 | 50 | Toluene: 60%<br>Butyl acetate: 20%<br>Cyclohexanone: 10%<br>Methyl ethyl ketone: 10% | 50 |
| 7 | 100 | 2.0 | 50 | Toluene: 60%<br>Butyl acetate: 20%<br>Cyclohexanone: 10%<br>Methyl ethyl ketone: 10% | 50 |
| 8 | 100 | 2.0 | 50 | Toluene: 60%<br>Butyl acetate: 20%<br>Cyclohexanone: 10%<br>Methyl ethyl ketone: 10% | 50 |

TABLE 2

| | Other additives | | | | | | |
|---|---|---|---|---|---|---|---|
| | Plasticizer (When weight of nitrocellulose is 100 parts by weight) | Other additives | Coating film of soft film Materials of group X | Coating film of soft film Materials of group Y | Solvent of soft film Materials of group Z | Coating film of soft film | Film thickness of solid lubricating Coating film (μm) |
| 1 | Zero | Zero | | | | | 45 |
| 2 | Zero | Zero | | | | | 45 |
| 3 | Zero | Zero | | | | | 45 |
| 4 | Zero | Zero | | | | | 45 |
| 5 | Zero | Zero | | | | | 170 * |
| 6 | Diethyl phthalate (DEP): 10 pbr | Zero | | | | | 45 |
| 7 | Diethyl phthalate (DEP): 10 pbr | Zero | | | | | 45 |
| | | | Stearic acid | Na | HFE | 15 μm | 15 |
| 8 | Diethyl phthalate (DEP): 10 pbr | Zero | | | | | 150 |
| | | | Stearic acid | Na | HFE | 15 μm | 15 |

TABLE 2-continued

| | Film hardness (Pencil hardness) | Make/break number of times: Experiment device | M/B number of times | Remarks |
|---|---|---|---|---|
| 1 | 2H | Horizontal tongs (No load application) (As axis is adjusted, no backlash) | ≥10 times | Comparative reference example Invention example |
| 2 | 2H | Vertical tongs (No load application) | 7 times | Comparative reference example Invention example |
| 3 | 2H | Weight tongs 1 ton (Vertical tongs applied with load equivalent to one actual length pin) | 4 times<br>3 times | Invention example |
| 4 | 2H | Stimulated well Use pipe of Range-3 (One actual length pin, about 1 ton is applied to box screw) | 3 times<br>3 times<br>4 times | Invention example |
| 5 | 2H | Weight tongs 1 ton (Vertical tongs applied with load equivalent to one actual length pin) | Once<br>Twice | Comparative example |
| 6 | H | Weight tongs 1 ton (Vertical tongs applied with load equivalent to one actual length pin) | ≥5 times<br>4 times | Invention example |
| 7 | H<br>5B | Weight tongs 1 ton (Vertical tongs applied with load equivalent to one actual length pin) | ≥5 times<br>≥5 times<br>≥5 times | Invention example |
| 8 | H<br>5B | Weight tongs 1 ton (Vertical tongs applied with load equivalent to one actual length pin) | 3 times<br>3 times | Invention example |

TABLE 3

| | Steel type | OD (inch) | WT (LPF) | Screw type | Side where the slolid lubication coating film is formed | Base film and base treatment | Solid lubricant: Fraction of MCA Fraction of other lubricants | Solid lubricant: Average particle diameter of MCA (μm) | Weight ratio of total solid weight agent and total binder resin ※When total weight of all binder resins is 100 parts by weight |
|---|---|---|---|---|---|---|---|---|---|
| 9 | Q125 | 9⅝" | 53.5# | JFELION ™ | CPLG Screw<br>PIN Screw | MnPhos<br>Shot blasted | MCA: 80%<br>BN: 20% | 10 | 60 pbr |
| 10 | Q125 | 9⅝" | 53.5# | JFELION ™ | CPLG Screw<br>PIN Screw | MnPhos<br>Shot blasted | MCA: 50%*<br>Graphite: 50% | 15* | |
| 11 | C110 | 9⅝" | 53.5# | JFELION ™ | CPLG Screw<br>PIN Screw | MnPhos<br>Shot blasted | MCA: 100% | 2 | |
| 12 | C110 | 9⅝" | 53.5# | JFELION ™ | CPLG Screw<br>PIN Screw | MnPhos<br>Shot blasted | MCA: 90%<br>PTFE: 10% | 1 | 15 pbr |
| 13 | C110 | 9⅝" | 53.5# | JFELION ™ | CPLG Screw<br>PIN Screw | MnPhos<br>Shot blasted | MCA: 100% | 1 | 5 pbr* |
| 14 | C110 | 9⅝" | 53.5# | JFELION ™ | CPLG Screw<br>PIN Screw | MnPhos<br>Shot blasted | MCA: 100% | 5 | 100 pbr |
| 15 | C110 | 9⅝" | 53.5# | JFELION ™ | CPLG Screw<br>PIN Screw | MnPhos<br>Shot blasted | MCA: 100% | 8 | 200 pbr* |

TABLE 3-continued

| | Binder resin (Alkyd + Nitrocellulose) | | | Solvent | |
|---|---|---|---|---|---|
| | Rate to total binder resin (%) | Weight ratio of nitrocellulose to alkyd resin | Oil length of alkyd resin | Medicine type | Blending ratio to total weight of solid lubricant and binder resin before film is formed (%) |
| 9 | 100 | 3.0 | 60 | Xylene: 55%<br>Butyl acetate: 10%<br>Cyclohexanone: 15%<br>Methyl isobutyl ethyl ketone: 20% | 60 |
| 10 | 100 | 3.0 | 60 | Xylene: 55%<br>Butyl acetate: 10%<br>Cyclohexanone: 15%<br>Methyl isobutyl ethyl ketone: 20% | 60 |
| 11 | 80*<br>Rest is melamine resin | 3.5* | 40 | Toluene | 50 |
| 12 | 85<br>Rest is melamine resin 15% | 1.0 | 45 | Toluene: 60%<br>Butyl acetate: 20%<br>Cyclohexanone: 10%<br>Methyl ethyl ketone: 10% | 80 |
| 13 | 100 | 1.0 | 45 | Toluene: 60%<br>Butyl acetate: 20%<br>Cyclohexanone: 10%<br>Methyl ethyl ketone: 10% | 80 |
| 14 | 100 | 2.0 | 50 | Toluene: 60%<br>Butyl acetate: 20%<br>Cyclohexanone: 10%<br>Methyl ethyl ketone: 10% | 50 |
| 15 | 100 | 0.4* | 70* | Toluene: 60%<br>Butyl acetate: 20%<br>Cyclohexanone: 10%<br>Methyl ethyl ketone: 10% | 50 |

TABLE 4

| | Other additives | | | | | | |
|---|---|---|---|---|---|---|---|
| | Plasticizer (When weight of nitrocellulose is 100 parts by weight) | Other additives | Coating film of soft film Materials of group X | Coating film of soft film Materials of group Y | Solvent of soft film Materials of group Z | Coating film of soft film | Film thickness of solid lubricating Coating film (μm) |
| 9 | Dibutyl phthalate (DBP): 5 pbr | Zero | | | | | 45 |
| | | | Stearic acid | Na | HFE | | 15 |
| 10 | Dibutyl phthalate (DBP): 5 pbr | Zero | | | | | 50 |
| 11 | | | | | | | 65 |
| 12 | Dibutyl phthalate (DBP) | 5 pbr | | | | | 70 |
| | | | Stearic acid | Ca, Ba | HFE | 20 μm | |
| 13 | Dibutyl phthalate (DBP) | 5 pbr | | | | | 70 |
| | | | Stearic acid | Ca, Ba | HFE | 20 μm | |
| 14 | Dimethyl phthalate (DMP) | 20 pbr | | | | | 45 |
| | | | Stearic acid | Ca, Ba | HFE | 20 μm | |
| 15 | Dimethyl phthalate (DMP) | 20 pbr | | | | | 45 |
| | | | Stearic acid | Na, Ca | HFE | 20 μm | |

TABLE 4-continued

| | Film hardness (Pencil hardness) | Make/break number of times: Experiment device | M/B number of times | Remarks |
|---|---|---|---|---|
| 9 | 3H | Weight tongs | 3 times | Invention |
| | | 1 ton | ≥5 times | example |
| | | (Vertical tongs applied | 4 times | |
| | | with load equivalent to | | |
| | 5B | one actual length pin) | | |
| 10 | 3H | Weight tongs | Once | Comparative |
| | | 1 ton | Zero times | example |
| | | (Vertical tongs applied | Twice | |
| | | with load equivalent to | | |
| | | one actual length pin) | | |
| 11 | 6H | Weight tongs | Twice | Comparative |
| | | 1 ton | ≥5 times | example |
| | | (Vertical tongs applied | Twice | |
| | | with load equivalent to | | |
| | | one actual length pin) | | |
| 12 | 2H | Weight tongs | ≥5 times | Invention |
| | | 1 ton | ≥5 times | example |
| | | (Vertical tongs applied | | |
| | | with load equivalent to | | |
| | 5B | one actual length pin) | | |
| 13 | 2H | Weight tongs | 3 times | Comparative |
| | | 1 ton | Once | example |
| | | (Vertical tongs applied | Once | |
| | | with load equivalent to | | |
| | 5B | one actual length pin) | | |
| 14 | F | Weight tongs | ≥5 times | Invention |
| | | 1 ton | ≥5 times | example |
| | | (Vertical tongs applied | 4 times | |
| | | with load equivalent to | | |
| | 5B | one actual length pin) | | |
| 15 | B | Weight tongs | 3 times | Comparative |
| | | 1 ton | Twice | example |
| | | (Vertical tongs applied | Twice | |
| | | with load equivalent to | | |
| | 4B | one actual length pin) | | |

For No. 1 to 10, materials of carbon steel high strength grade: Q125 were used. For No. 11 to 15, materials of carbon steel sour grade: C110 were used. In addition, all the examples are cases of using the coupling connection and the pin connection of the oil country tubular goods having a size of 9 to ⅝" 53.5 #. In addition, the connection type is JFELION™.

<No. 1 to 10>

[No. 1 to 4]

Cases of No. 1 to 4 are comparative evaluation results regarding differences in power tongs to be evaluated. In all the cases of No. 1 to 3, the parameters of the materials are in a suitable range and under the same conditions. However, only the condition of make-up and break-out by the tongs is different.

No. 1 uses horizontal tongs, No. 2 uses simple vertical tongs, and No. 3 uses vertical tongs, but a test (hereinafter, the test is also referred to as the weight tong test) based on the new laboratory test with a weight was employed. Further, No. 4 corresponds to the result of the make-up and break-out test using a pipe of Range-3 (more than 12 m, more than about 40 ft) in a simulated well.

No. 1 is a case where the make-up and break-out could be performed 10 times or more (stopped after 10 times). In No. 2, the make-up and break-out was performed up to seven times. No. 3 indicates that the number of times of make-up and break-out could be three and four after two times of tests. Further, No. 4 indicates that the number of times of make-up and break-out could be three, three, and four after three times of tests.

In No. 1, the weight of the short pin connection is not applied to the coupling connection. At the same time, in No. 1, since the axis is also adjusted, the unbalanced load based on the backlash of the connection is not applied.

On the other hand, No. 2 is a test in a state where the weight of one short pin is applied to the coupling thread. Note that in the case of this size, the short pin of 1 m has a weight of about 100 kg.

No. 3 is a simulation in a state where 1 ton corresponding to one actual pin is applied. In addition, in No. 3, as described above, the make-up is started from a state in which the set position of the pin is intentionally semi-tightened so that about a half of the pin threads is exposed from the coupling connection. As a result, the threads are not engaged with each other and there is backlash as occurs in the actual well. That is, the make-up and break-out conditions simulate a state in which the solid lubricating coating film is damaged.

No. 4 corresponds to the make-up and break-out conditions under conditions very similar to the make-up conditions in the actual well.

No. 3 and No. 4 correspond to present invention examples.

No. 1 and 2 are comparative reference examples in which the number of times of make-up and break-out exceeds the pass line. No. 3 and 4 correspond to present invention examples according to the results.

What No. 1 and 2 mean is that unless the upper and lower limits of the parameters defined in the present disclosure are described by evaluating with the weight tongs close to the actual well, the evaluation is optimistic. That is, in the methods that have been used in many patent literatures so far, the evaluation of the solid lubricating coating film results in the optimistic evaluation. Thus, it is suggested that the conventional laboratory test is not suitable as the evaluation method. It also means that the situation in the actual well can be simulated by the test method with the weight tongs.

Here, as a reference experiment not incorporated in this example (a case not described in the table), the following well experiment, which has been widely conducted conventionally, was also performed under the same tong conditions as No. 1 to 4. That is, a Mn phosphate film was formed on the coupling connection, and a BOL-72733 API-mod grade grease-like compound produced by Best-O-Life was applied to the pin connection on a shot blasted skin, and the make-up and break-out test was performed. In this case, the number of times of make-up and break-out was 5 or more in any case, and no difference was found. These indicate that the grease compound moves in conjunction with the make-up and break-out of the connection, and thus it is not affected by the conditions of the test method to be evaluated (tong conditions to be evaluated) as much as the solid lubricating coating film.

As described above, it has been found that the test for proving significance of the parameters of the solid lubricating coating film needs to be performed in the actual well test, a simulated well test, or the new laboratory test (weight tong test).

[No. 5 to 8]

No. 5 to No. 8 are examples of comparison under substantially the same conditions. This case is mainly for the study of changing the film thickness of the solid lubricating coating film, and the study of the presence or absence of shot blast, the presence or absence of the plasticizer, and the presence or absence of another type of solid lubricating coating film on the pin connection side.

No. 5 is a case where the film thickness exceeds the upper limit of the present disclosure, and other parameters are in a suitable range. No. 5 is a case where the film was thick, so that the product derived from the damaged solid lubricating coating film is clogged in the connection gap during make-up and break-out, and was seized early.

No. 6 is a case where the film thickness is in a suitable range, and the plasticizer is further added. No. 5 has a pencil hardness of 1 rank softer, but can be made up and broken out more than specified, and corresponds to a present invention example.

No. 7 is a present invention example in a state where the solid lubricating coating film is provided on the coupling connection under the same conditions as No. 6, and the soft film is formed on the pin connection side. When the solid lubricant mainly containing MCA is prepared according to the present disclosure, the connection having a film formed by blending the nitrocellulose and the alkyd resin within the scope of the present disclosure is prepared, and the soft solid lubricating coating film is attached to a thread surface on the opposite mating material side, the number of times of make-up and break-out is further increased, that is, it is apparent that the lubrication properties are improved.

No. 8 is a present invention example in which the upper limit of the film thickness of the solid lubricating coating film is 150 μm.

In No. 5 having a film thickness of 170 μm, the number of times of make-up and break-out was less than 3, but in No. 8, the number of times of make-up and break-out reached a pass level. The upper limit of the film thickness is 150 μm.

[No. 9 and 10]

The case of No. 9 is a case of a solid lubricant containing 80 wt % MCA and 20 wt % BN for solid lubrication. The case of No. 9 corresponds to a present invention example, in which all the parameters are within a suitable range.

The case of No. 10 is a case where the proportion of MCA in the solid lubricant is smaller than the disclosed specified range, and the average particle diameter of MCA is larger than the disclosed specified range. The case of No. 10 is a case where the seizure occurred early in the make-up and break-out test although other regulations were in a suitable range, and corresponds to a comparative example.

<No. 11 to 15>

No. 12 and 14 correspond to present invention examples, in which the components are adjusted within a suitable range.

On the other hand, No. 11, 13, and 15 correspond to comparative examples.

No. 11 is a case where 20% melamine resin is contained in addition to the nitrocellulose and alkyd binder resin components, and the nitrocellulose is blended in an amount exceeding a specified amount. This condition is also one of the causes, and No. 11 is a case where the film quality is brittle. No. 11 is a case to be a comparative example, in which there was only one example having the number of times of make-up and break-out exceeding 5 times, but the remaining two examples had the number of times of make-up and break-out of less than 3 times.

No. 13 is a case where the solid lubricant was too small relative to the binder resin, and thus lubrication could not be maintained and the seizure occurred.

On the contrary, No. 15 is a case where the solid lubricant is blended beyond the range specified in the disclosure, the blending ratio of the nitrocellulose is lower than the specified value, and the oil length of the alkyd resin is greater than the specified value. Then, No. 15 is a case where the number of times of make-up and break-out could not reach the specified value.

No. 12 and 14, in which the parameters are within the specified ranges of the present disclosure, had a larger number of times of make-up and break-out than No. 11, 13, and 15.

Comparison of No. 1 to 15 showed that the average particle diameter of melamine cyanurate must be 0.1 μm or more and 10.0 μm or less. Further, it was shown that the component weight of "alkyd resin and nitrocellulose" in the binder resin must be 85 wt % or more with respect to the total binder resin component weight. Further, the total weight of the solid lubricant is 10 parts by weight or more and 100 parts by weight or less when the total weight of the binder resin is 100 parts by weight. Further, it was shown that the thickness of the solid lubricating coating film must be 10 μm or more and 150 μm or less.

Example 2

Among the examples of Example 1, several examples were selected and subjected to a salt water spray test to check the corrosion resistance.

Among the cases shown in Example 1, cases were picked up from the conditions of the carbon steel-based connection for oil country tubular goods of No. 3, 6, and 14, and the salt water spray test was performed.

The material was newly formed on the coupling sample for this salt water spray test.

In addition, as a comparative example, SPCC (ordinary general mild steel thin steel sheet/cold rolled annealed plate) having a thickness of 0.8 mmt was also used (condition A).

The connection for oil country tubular goods material was made up and broken out once with a protector on both ends of the coupling connection, and cases as it is (No. 3-2, 6-2, and 14-2) and cases in which the protector was attached again (corresponding to a second make-up: No. 3-3, 6-3, and 14-3) were employed. Then, the samples are arranged side by side. That is, a corrosion test was performed by arranging the samples side by side without standing and performing the salt water spray test.

At this time, the pin connection was made into a sample of only a thread, and the side with the connection was made up and broken out once with the protector. An imide tape was attached to the outside where the protector was not attached again, to protect the inside of the pipe from water.

Detailed conditions are as follows. That is, the conditions of the solid lubricating coating films of No. 3-2, 3-3, 6-2, 6-3, 14-2, and 14-3 correspond to the same conditions as those of No. 3, 6, and 14 of Example 1.

The significance of this test method is that the connection for oil country tubular goods is shipped after the end is tightened with the protector, and is often stored in a yard near the well as it is. This is because the environment is close to actual use conditions. The condition that the protector is not attached means a more severe condition when the protector is removed. The case of SPCC thin plate is a case of being not made up and broken out with the protector, and the corrosion resistance of the film itself is seen in the shape of the connection.

<Salt Water Spray Conditions>

Spray conditions: JIS K 5600-7-1

Salt water concentration: 5±0.5 wt %

Temperature: 35° C.

Humidity: 98 to 99%

Spray amount: 1 to 2 mL/hr/80 $cm^2$ pH: 6.5 to 7.2

Time: 24 hr

The results are shown in Table 5.

TABLE 5

| No. | Steel type | OD (inch) | WTwt (LPF) | Screw type | Conditions of solid lubricating coating film |
|---|---|---|---|---|---|
| A | SPCC | 75 mm × 150 mm × 10.8 mm (Thin steel sheet) | | | Example 1 - Solid lubricating coating film on coupling screw film side under the same conditions as No. 3 |
| 3-2 | 125 | 9⅝" | 53.5# | JFELION ™ CPLG Screw | Example 1 - Solid lubricating coating film on coupling screw film side under the same conditions as No. 3 |
| 3-3 | Q125 | 9⅝" | 53.5# | JFELION ™ CPLG Screw | Example 1 - Solid lubricating coating film on coupling screw film side under the same conditions as No. 3 |
| 6-2 | Q125 | 9⅝" | 53.5# | JFELION ™ CPLG Screw | Example 1 - Solid lubricating coating film on coupling screw film side of No. 5 |
| 6-3 | Q125 | 9⅝" | 53.5# | JFELION ™ CPLG Screw | Example 1 - Solid lubricating coating film on coupling screw film side of No. 5 |
| 14-2 | C110 | 9⅝" | 53.5# | JFELION ™ CPLG Screw | Example 1 - Solid lubricating coating film on coupling screw film side of No. 13 |
| 14-3 | C110 | 9⅝" | 53.5# | JFELION ™ CPLG Screw | Example 1 - Solid lubricating coating film on coupling screw film side of No. 13 |

| No. | Processing before salt water spray | Sample state in salt water spray | Corrosion results | Remarks |
|---|---|---|---|---|
| A | None (Full back surface: Imide tape) (There is an imide tape 10 mm from end surface on evaluation side) | Diagonal standing (Set in polyvinyl chloride comb-shaped jig) | No corrosion | Comparative reference example |
| 3-2 | One Make/Break with protector | Placed horizontally on salt water spray device as it is (means not to stand) | No corrosion | Present invention example |
| 3-3 | One Make/Break with protector | Attached with protector once again and placed horizontally on salt water spray device (means not to stand) | No corrosion | Present invention example |
| 6-2 | One Make/Break with protector | Placed horizontally on salt water spray device as it is (means not to stand) | No corrosion | Present invention example |
| 6-3 | One Make/Break with protector | Attached with protector once again and placed horizontally on salt water spray device (means not to stand) | No corrosion | Present invention example |

TABLE 5-continued

| | | | | |
|---|---|---|---|---|
| 14-2 | One Make/Break with protector | Placed horizontally on salt water spray device as it is (means not to stand) | No corrosion | Present invention example |
| 14-3 | One Make/Break with protector | Attached with protector once again and placed horizontally on salt water spray device (means not to stand) | No corrosion | Present invention example |

As can be seen from Table 5, it was found that none of No. 3-2, 3-3, 6-2, 6-3, 14-2, and 14-3 including No. A of the comparative example corroded in salt water spraying and had sufficient corrosion resistance.

The film quality is F or more and hard, and even if it is made up and broken out by the protector, it is not fatally damaged. In addition, it is presumed to be important that the main components of MCA, nitrocellulose, and alkyd are water-repellent, and do not attract water.

Here, the entire contents of Japanese Patent Application No. 2021-91464 (filed on May 31, 2021), the priority of which is claimed by the present application, are a part of the present disclosure by reference. Here, the description has been made with reference to a limited number of embodiments, but the scope of rights is not limited thereto, and modifications of each embodiment based on the above disclosure are obvious to those skilled in the art.

REFERENCE SIGNS LIST

1 Pin
1*a* Male thread
2 Box (Coupling)
2*a* Female thread
3 Weight
3A Weight body
4 Power tongs
10A Solid lubricating coating film
10B Base layer
12 Penetrating rod
13 Insertion rod
20 Suspension device (crane)
21 Chain (Sling)

The invention claimed is:

1. An agent for forming a solid lubricating coating film on a thread portion of oil country tubular goods, wherein
a solid lubricant is dispersed in a binder resin,
a main component of the solid lubricant is melamine cyanurate, and an average particle diameter of the melamine cyanurate is 0.1 μm or more and 10.0 μm or less,
the binder resin contains an alkyd resin and nitrocellulose, and the alkyd resin and nitrocellulose are contained in an amount of 85 wt % or more of the total binder resin component weight, and
a total weight of the solid lubricant is 10 parts by weight or more and 100 parts by weight or less based on 100 parts by weight of a total weight of the binder resin.

2. The agent according to claim 1, wherein a weight of the nitrocellulose is 0.5 times or more and 3 times or less a weight of the alkyd resin.

3. The agent according to claim 1, comprising
a solvent, wherein
the solvent contains one or more materials selected from mineral spirits, aromatics, alcohols, ester-based solvents, and ketone-based solvents, and
a weight of the solvent is 20% or more and 80% or less of the total weight of the solid lubricant and the binder resin.

4. The agent according to claim 1, wherein an oil length of the alkyd resin is 10 to 60.

5. The agent according to claim 1, comprising:
one or more materials selected from dibutyl phthalate (DBP), dimethyl phthalate (DMP), and diethyl phthalate (DEP) as a plasticizer; and
the plasticizer in an amount of 10 parts by weight or more and 20 parts by weight or less based on 100 parts by weight of the nitrocellulose.

6. Oil country tubular goods with a lubricating coating film including a solid lubricating coating film formed on a thread portion, wherein
the solid lubricating coating film includes a solid lubricant dispersed in a binder resin,
a main component of the solid lubricant is melamine cyanurate, and an average particle diameter of the melamine cyanurate is 0.1 μm or more and 10.0 μm or less,
the binder resin contains an alkyd resin and nitrocellulose, and the alkyd resin and nitrocellulose are contained in an amount of 85 wt % or more of the total binder resin component weight,
the total weight of the solid lubricant is 10 parts by weight or more and 100 parts by weight or less with respect to 100 parts by weight of the total weight of the binder resin, and
a thickness of the solid lubricating coating film is 10 μm or more and 150 μm or less.

7. The oil country tubular goods according to claim 6, wherein
the lubricating coating film includes a base layer between a tightening surface of the thread portion and the solid lubricating coating film, and
the base layer includes a Mn phosphate chemical conversion treatment film, a zinc phosphate chemical conversion treatment film, or an electroplating film containing one or more metals selected from Cu, Sn, and Zn.

8. The oil country tubular goods according to claim 6, wherein
the solid lubricating coating film has a pencil hardness of 2B or more.

9. A threaded joint for oil country tubular goods connecting a box having a female thread and a pin having a male thread, wherein
at least one oil country tubular goods of the box and the pin includes the oil country tubular goods on which the lubricating coating film is formed according to claim 6.

10. The threaded joint for oil country tubular goods according to claim 9, wherein the lubricating coating film including the solid lubricating coating film is formed on a thread portion of one of the box and the pin, and a second solid lubricating coating film that is softer than the solid lubricating coating film is formed on a thread portion of the other of the box and the pin.

11. The threaded joint for oil country tubular goods according to claim 10, wherein the second solid lubricating coating film is formed by dispersing a second solid lubricant in a second binder resin, the second binder resin contains a fluorine-based organic compound as a main component, and the second solid lubricant contains one or more compounds using a material selected from fatty acids in the following group X and a material selected from metal elements in the following group Y:

Group X: stearic acid, isostearic acid, behenic acid, lauric acid, and 12-hydroxystearic acid;

Group Y: Li, Na, Mg, Al, Ca, Zn, and Ba.

12. The threaded joint for oil country tubular goods according to claim 10, wherein the second solid lubricating coating film has a pencil hardness of 3B or less.

13. The agent according to claim 2, comprising a solvent, wherein the solvent contains one or more materials selected from mineral spirits, aromatics, alcohols, ester-based solvents, and ketone-based solvents, and a weight of the solvent is 20% or more and 80% or less of the total weight of the solid lubricant and the binder resin.

14. The agent according to claim 2, wherein an oil length of the alkyd resin is 10 to 60.

15. The agent according to claim 3, wherein an oil length of the alkyd resin is 10 to 60.

16. The agent according to claim 13, wherein an oil length of the alkyd resin is 10 to 60.

17. The agent according to claim 2, comprising:

one or more materials selected from dibutyl phthalate (DBP), dimethyl phthalate (DMP), and diethyl phthalate (DEP) as a plasticizer; and the plasticizer in an amount of 10 parts by weight or more and 20 parts by weight or less based on 100 parts by weight of the nitrocellulose.

18. The agent according to claim 3, comprising:

one or more materials selected from dibutyl phthalate (DBP), dimethyl phthalate (DMP), and diethyl phthalate (DEP) as a plasticizer; and the plasticizer in an amount of 10 parts by weight or more and 20 parts by weight or less based on 100 parts by weight of the nitrocellulose.

19. The agent according to claim 4, comprising:

one or more materials selected from dibutyl phthalate (DBP), dimethyl phthalate (DMP), and diethyl phthalate (DEP) as a plasticizer; and the plasticizer in an amount of 10 parts by weight or more and 20 parts by weight or less based on 100 parts by weight of the nitrocellulose.

20. The agent according to claim 13, comprising:

one or more materials selected from dibutyl phthalate (DBP), dimethyl phthalate (DMP), and diethyl phthalate (DEP) as a plasticizer; and the plasticizer in an amount of 10 parts by weight or more and 20 parts by weight or less based on 100 parts by weight of the nitrocellulose.

* * * * *